US009404296B2

(12) United States Patent
McMahon

(10) Patent No.: US 9,404,296 B2
(45) Date of Patent: Aug. 2, 2016

(54) RECESSED HANDLE LEVER FOR LIFT AND SLIDE DOOR

(71) Applicant: Nanz Custom Hardware, Inc., New York, NY (US)

(72) Inventor: Stephen McMahon, North Haven, NY (US)

(73) Assignee: NANZ CUSTOM HARDWARE, INC., New York, NY (US)

( * ) Notice: Subject to any disclaimer, the term of this patent is extended or adjusted under 35 U.S.C. 154(b) by 130 days.

(21) Appl. No.: 14/222,022

(22) Filed: Mar. 21, 2014

(65) Prior Publication Data

US 2015/0267443 A1 Sep. 24, 2015

(51) Int. Cl.

| | |
|---|---|
| ***E05B 3/00*** | (2006.01) |
| ***E05C 3/16*** | (2006.01) |
| ***E05B 65/08*** | (2006.01) |
| ***E05B 5/02*** | (2006.01) |

(52) U.S. Cl.

CPC . *E05C 3/16* (2013.01); *E05B 5/003* (2013.01); *E05B 65/08* (2013.01); *Y10T 292/57* (2015.04)

(58) Field of Classification Search

CPC ..... Y10T 292/57; Y10T 70/5761; Y10T 292/1092; Y10T 292/108; Y10T 70/7655; Y10S 292/31; Y10S 292/37; Y10S 292/30; E05B 5/003; E05B 85/107; E05B 5/00; E05B 17/183; E05B 85/14; E05C 3/041

USPC ..... 292/336.3, DIG. 31

See application file for complete search history.

(56) References Cited

U.S. PATENT DOCUMENTS

| | | | | |
|---|---|---|---|---|
| 2,599,054 | A | 6/1952 | Gates et al. | |
| 4,706,478 | A * | 11/1987 | Swan | E05B 5/00 292/336.3 |
| 8,291,732 | B2 * | 10/2012 | Ramsauer | E05B 1/0092 292/32 |
| 8,919,047 | B2 * | 12/2014 | Johnsrud | E05B 85/103 292/336.3 |
| 2011/0156411 | A1 | 6/2011 | Commons et al. | |
| 2012/0240718 | A1 | 9/2012 | Goetze | |

FOREIGN PATENT DOCUMENTS

| | | | |
|---|---|---|---|
| DE | 202007004434 | U1 | 9/2008 |
| DE | 202007004435 | U1 | 9/2008 |
| WO | 2008116533 | A2 | 10/2008 |

OTHER PUBLICATIONS

International Bureau, "International Search Report and Written Opinion dated Jul. 27, 2015", PCT Application No. PCT/US2015/020504, 12 pages.

* cited by examiner

*Primary Examiner* — Mark Williams
(74) *Attorney, Agent, or Firm* — Dorsey & Whitney LLP

(57) ABSTRACT

A handle assembly for use with a lift and slide door system. The handle assembly includes a support frame configured to be received within a recess defined on a surface of a door panel and a handle rotationally and movably connected to the support frame. With the handle assembly, in a first position the handle is substantially flush with the surface of the door panel and in a second position the handle includes a first component that is substantially parallel to the outer surface of the door panel and a second component that is substantially perpendicular to the outer surface of the door panel.

22 Claims, 19 Drawing Sheets

RECESSED HANDLE LEVER FOR LIFT AND SLIDE DOOR

TECHNICAL FIELD

The present disclosure relates generally to hardware for doors in architectural structures, and more specifically to a lever for operating lift and slide doors.

BACKGROUND

Sliding glass doors are often used as exterior doors in structures to allow ingress and egress to the structure while providing a strong weather seal against the elements. Typical sliding glass doors have a stationary panel and a sliding panel that slides along one side of the stationary panel to provide a functional opening for about half of the width of the door opening. Because one panel is stationary, the functional opening is limited to only one side of the door opening. Typically, sliding glass doors are used in openings between six and ten feet long. By pass doors may be used to cover larger openings, but are usually limited to operation on two tracks such that only one door panel can be positioned behind another. This limits the width of the functional opening of the door opening, although the open width can be located on either side (and sometimes in an intermediate area) of the door opening as opposed to sliding glass doors. Unlike sliding glass doors, bypass doors are typically not used for external applications as there is no ability to weather seal the panels.

Lift and slide doors are configured with singular or multiple panels and are used in architectural structures, primarily on exterior walls, to enclose an expanse, for example, openings of 4-48 feet. More importantly nearly all panels of lift and slide doors move to allow for such wide expanses to be completely opened to the exterior without any structural interference. The panels may bypass each other and be stored as a stack within a pocket at one or both sides of the opening or, in other configurations, may pivot at a location adjacent a lateral end to stack flat against a side wall defining the opening. The panels roll on bearings along a metal track recessed within the floor such that a very low bead extends very slightly above the surface of the floor. The top edges of the panels are retained within a track provided in the lintel of the opening.

When the door panels are in a closed position, the bases of the panels rest upon the floor and typically have a weather strip along a bottom edge to seal out water and drafts. Similarly, the lateral edges of the panels seal against each other. A channel in the base of the door receives the bead of the track. To open the door system, each panel is lifted off of the floor onto the track by moving a bearing structure into the channel within the panel base and engaging the exposed bead of the metal track. A mechanism in the door forces the bearing system downward with respect to the rest of the panel onto the metal track such that the panel is lifted off the floor and can slide along the track on the bearings. The panels are very heavy so significant leverage is required to force the bearing structure downward onto the track to raise the panel. Typically a handle or lever is used to actuate the bearing system in each panel through a linkage. The handle may be removable where the user engages the handle as a lever on each panel in succession, usually by connecting with the linkage and then rotating the handle 180 degrees to actuate the linkage and the bearing system for the panel. Alternatively, the handle is mounted to the door and the mechanism and the door typically will have a pocket cutout to allow for the projection of the handle or the panels must be stored in a staggered, partially open position to allow for the projection of the handles from the doors.

With a removable handle, a first panel is lifted off the floor and is resting on the track, the user removes the handle from the first panel and connects the handle to the next panel to similarly actuate it. Once the last panel is actuated, a user can move the first door along the track, bypassing the next adjacent panel. Typically, the panels are designed to connect with and collect each adjacent panel as the panels slide along the track. Conventional handle levers for these lift and slide doors stick outwards from the face of the panel when engaged. If the stack of panels is to be hidden within a pocket in the sidewall, the handle lever must be removed and stored somewhere for later use when closing the door panels. Further, if handles are attached permanently to any panel (except perhaps the end panel), the panels cannot slide past each other completely which would diminish the possibility for a hidden pocket door system.

The information included in this Background section of the specification, including any references cited herein and any description or discussion thereof, is included for technical reference purposes only and is not to be regarded subject matter by which the scope of the invention as defined in the claims is to be bound.

SUMMARY

One embodiment of the present disclosure may take the form of a handle assembly for use with a lift and slide door system. The handle assembly includes a support frame configured to be received within a recess defined on a surface of a door and a handle rotationally and movably connected to the support frame. With the handle assembly, in a first position the handle is substantially flush with the surface of the door and in a second position the handle includes a first component that is substantially parallel to the outer surface of the door and a second component that is substantially perpendicular to the outer surface of the door.

Another embodiment of the disclosure may take the form a lever assembly for a lift and slide door system. The lever assembly includes a support structure configured to connect to a door of the lift and slide door system, a lever comprising a user selectable component, and a biasing member connected to the lever. With the lever assembly, selection by the user of the user selectable component allows the biasing member to move the lever from a nested position relative to the support structure to an extended position relative to the support structure.

Yet another embodiment of the disclosure may take the form of a handle assembly. The handle assembly includes a support assembly configured to connect to a door, a handle movably connected to the support assembly, and a biasing assembly connected to the handle. The biasing assembly is configured to selectively move the handle from a first position relative to the support assembly to a second position relative to the support assembly.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. A more extensive presentation of features, details, utilities, and advantages of the present invention as defined in the claims is provided in the following written description of various embodiments of the invention and illustrated in the accompanying drawings.

SPECIFICATION

Overview

Figure 1A:
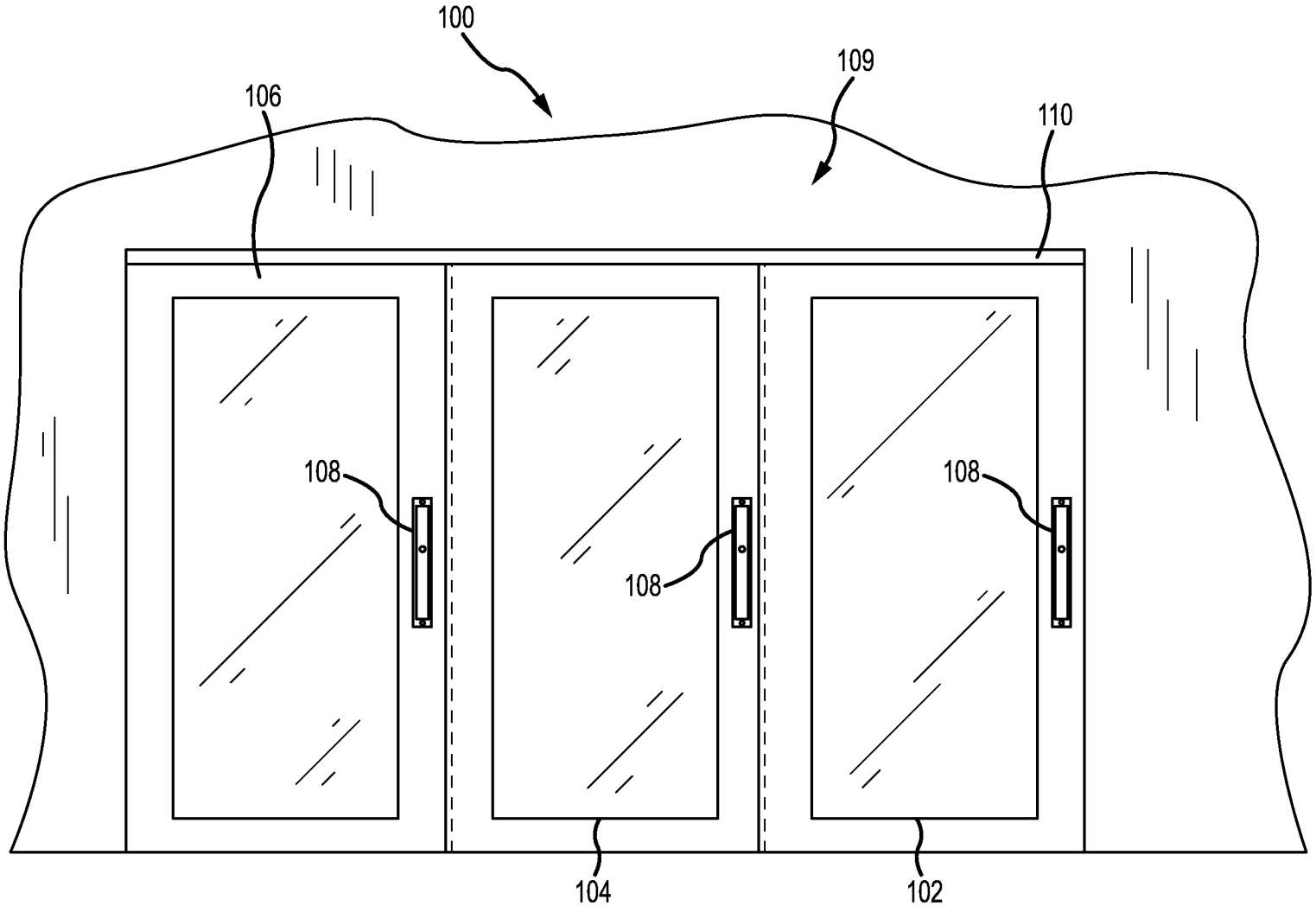
FIG. 1A is a front elevation view of a door system including a handle assembly of the present disclosure with the doors closed.

The present disclosure is related to levers for lift and slide door panels. The lever or handle allows a user to actuate the panels in order to open and close the sliding door system. The lever is primarily envisioned to be used with lift and slide door assemblies, but may conceivably be used with substantially any type of door. The lever assembly includes a handle nested into a recess of the door when not in use. This allows the handle to be substantially flush with an outer surface of the door when not being used. By being substantially flush with an outer surface of the panel, such as a face, the panel may be easily stored, such as in a pocket structure of a door frame. The panel may be stacked against other panels or another structure without the handle interfering with the position of the panel. As will be discussed in more detail below, to use the handle, the user can actuate the handle, which causes the handle to move outward from the recess in the panel surface. This allows the user to grip the handle and provide a lever-type function to reduce the force required by the user to actuate the panel, such as to lift the panel onto a track.

To use the handle, the user presses an actuator, such as a push button, switch, or the like. The handle is then forced outwards from the recess to extend away from the panel. This movement allows the handle to be easily accessible by a user, and the user may easily grip the handle. Once extended, the handle can be rotated and locked into a first position. This rotation actuates a typical mechanism in the lift and slide door panel to raise the panel off the ground and move a bearing system in contact with an exposed bead of a track in the floor. The user can then grip the handle and apply a force in the direction he or she desires the door to be moved. The length of the handle away from the rotational or pivot point provides the functional lever arm strength of the handle and allows a user to used a reduced force as compared to a shorter lever arm in order to lift the panel and actuate the bearing system in the panel. After use, the user can move the handle back into its recessed position within the panel, thus allowing other panels to slide past it without interference.

The lever assembly may include a handle, an outer frame, a handle linkage, an actuating assembly, and a biasing assembly. The outer frame is designed to fit within a recess in the face of the panel in a location similar to typical door handle hardware and thereby connect lever assembly to the panel. However, unlike typical door handles, the handle nests into the face of the panel, for example, the outer frame also defines a cavity to receive the handle. The handle connects to the outer frame via the handle linkage and is received within the cavity of the outer frame in a nested position. In this nested position the handle may be substantially flush with the outer surface of the panel within which the outer frame is installed. The outer frame may have a decorative lip or flange that may be substantially flush with the face of the panel as well.

The biasing assembly includes one or more biasing members that are connected to one or more lever arms in the handle linkage via a yoke. The lever arms extend from the outer frame and connect the handle to the outer frame. The yoke secures the one or more biasing members together and allows the biasing members to exert a combined force on the lever arms. When actuated, the biasing members force the lever arms outward and upward from the outer frame, which, in turn, move the handle outward and upward from the outer frame. The biasing members may be substantially any type of component that can provide a mechanical force, however, in some embodiments the biasing members may be springs such as gas actuated springs, or the like.

The actuation assembly allows a user to release the handle from a nested position within the outer frame. The actuation assembly may include an actuator, such as a button or other user selectable component, a button spring, and a latch spring, and a latch. In a first position, the latch engages with a hub connected to the outer frame and the lever arms of the biasing assembly. The latch locks the biasing assembly to prevent the biasing force of the biasing members from forcing the handle outward and upward. To release the handle, the user selects the actuator, which compresses the button spring into a second position. As the actuator is pressed inward, the button spring is compressed and the actuator engages the latch and moves the latch laterally. As the latch moves, it compresses the latch spring, and the latch disengages from the hub. Once the latch is disengaged, the biasing assembly forces the handle linkage upward and outward to move the handle outward and upward.

When the handle is extended outward from the outer frame, the handle is able to be grasped by a user. In some embodiments, the handle and handle linkage may also be rotatable relative to the outer frame. In these embodiments, once the biasing assembly has extended the handle, a user may rotate the handle (e.g., 180 degrees) to unlatch the door panel. In the case of a lift and slide door panel, "unlatching" means that the handle rotation operates to interface with a mechanism in the to the panel to raise or lower the panel and engage or disengage the bearing system in the panel with the tracks. Once the panel is lifted and the bearing system engages the track the user can move the panel along the length of the track. If an adjacent panel needs to bypass another panel, the handle can be pushed back into the cavity of the outer frame. In the nested position, the latch spring biases the latch towards a catch or groove defined in the hub to lock the handle in position.

If a panel needs to be set on the floor, e.g., when the opening is needs to be closed and sealed to prevent outside weather elements (e.g., rain, wind) from entering the structure, the actuator may be pressed to release the handle and the handle can be rotated (e.g., 180 degrees in the opposite direction to an original position), thus removing the bearing system from the track and lowering the panel to the floor. The handle can then be pushed back into a nested position within the outer frame flush with the surface of the panel for a smooth aesthetic appearance.

The lever assembly allows the handle to be substantially flush with the outer surface of the panel when not in use. The flush orientation of the handle allows the panels to slide past one another and also allows the panels to be stored against each other and/or within a wall pocket. For example, the panels are typically stored within a cavity defined within a structure, such as the frame of the door opening. Because the handle is flush with the face of the panel, the panel can slide into the pocket of the door frame and the handle will not protrude past the edge of the door frame. The handle may be used with panels in lift and slide door assemblies and, with the related linkage, provides sufficient leverage to allow a user to engage the lifting mechanisms in the panels that may often weigh several hundred pounds each. Conventional lift and slide handles extend from the panel surface to provide for the lever action to offset the weight of the panels and are removable once the panels have been lifted onto the tracks in order for the panels to slide past one another.

Detailed Description

Figure 1B:
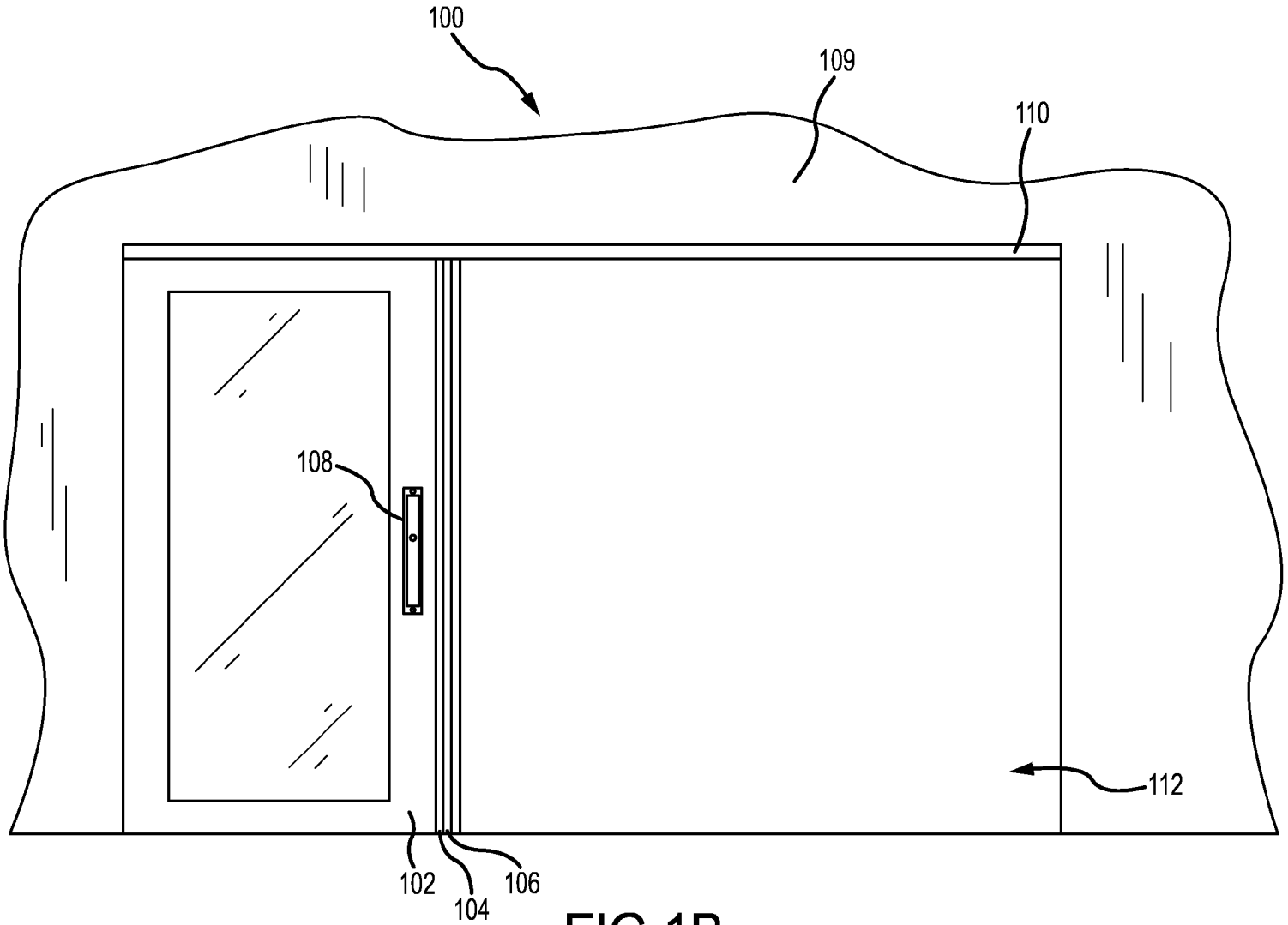
FIG. 1B is a front elevation view of the door system of FIG. 1A with the first two doors in the open position.
Figure 2:
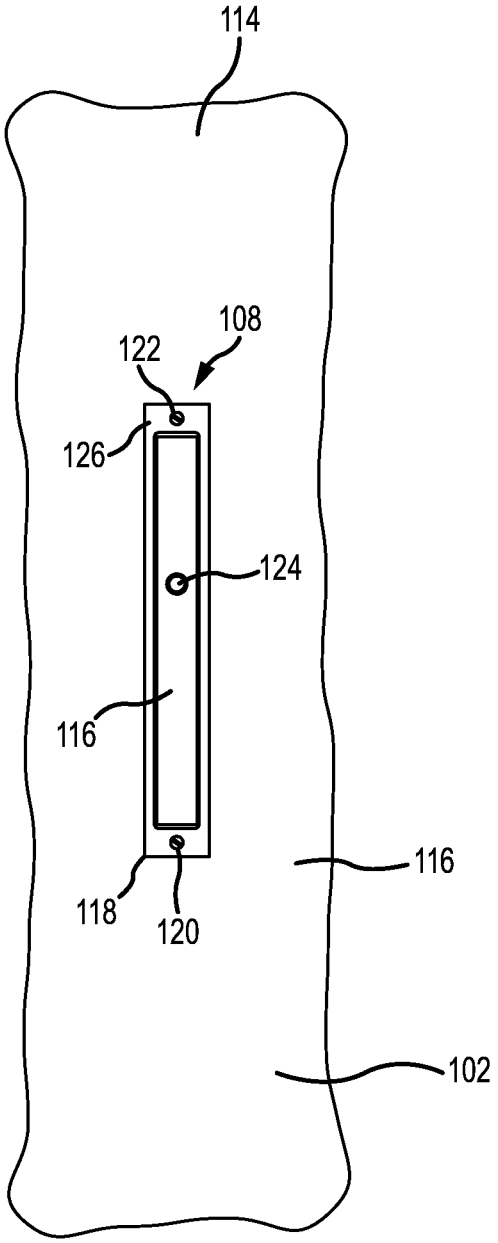
FIG. 2 is an enlarged front elevation view of first door illustrating the handle assembly with the handle in the closed position.

Turning to the figures, a handle assembly of the present disclosure will now be discussed in more detail. FIG. 1A is a front elevation view of a lift and slide door system 100 including the handle assembly 108 with a first panel in a first position. FIG. 1B is a front elevation view of the door system 100 of FIG. 1A with the first panel in a second position. FIG. 2 is an enlarged view of the panel illustrating the handle assembly with a handle in the nested position. With reference to FIGS. 1A, 1B, and 2, the door system 100 may include a door opening 112 defined in a structure 109. The structure 109 may typically be a wall or other dividing structure. The door opening 112 allows areas (e.g., rooms, patios, yards, etc.) to be accessible from other areas. The door system 100 may include one or more panels 102, 104 that selectively close the door opening 112. In one embodiment, the door system 100 may include a first or master panel 102 and a second or slave panel 104 that slide across the door opening 112. In some embodiments, movement of the master panel 102 causes movement of the slave panel 104. For example, as the master panel 102 is moved laterally across the door opening 112, the master panel 102 may collect the slave panels 104, 106 with an interface mechanism (not shown) as the master panel 102 slides past the slave panel 104, thereby correspondingly laterally moving the slave panels 104, 106 across the door opening 112.

The master panel 102 and the slave panels 104, 106 are connected to the structure 109 by a track 110. The track 110 defines a path for movement of the master panel 102 and the slave panel 104. For example, the panels 102, 104, 106 may include bearings, wheels, or other low friction components that slide, roll, or otherwise move along the track 110. The type of track 110 and the type of connection between the track 110 and the master panel 102 and slave panel 104 may be varied as desired.

The handle assembly 108 connects to one or more of the panels of the door system 100. In one embodiment, the handle assembly 108 connects to the master panel 102 on a face 114 of the master panel 102. For example, a handle recess 118 is defined in the outer surface 116 of the panel face 114 and the handle assembly 108 is received in the handle recess 118 and connected to the master panel 102. The position of the handle assembly 108 may be selected to allow the handle assembly to be accessible by a user.

Figure 3:
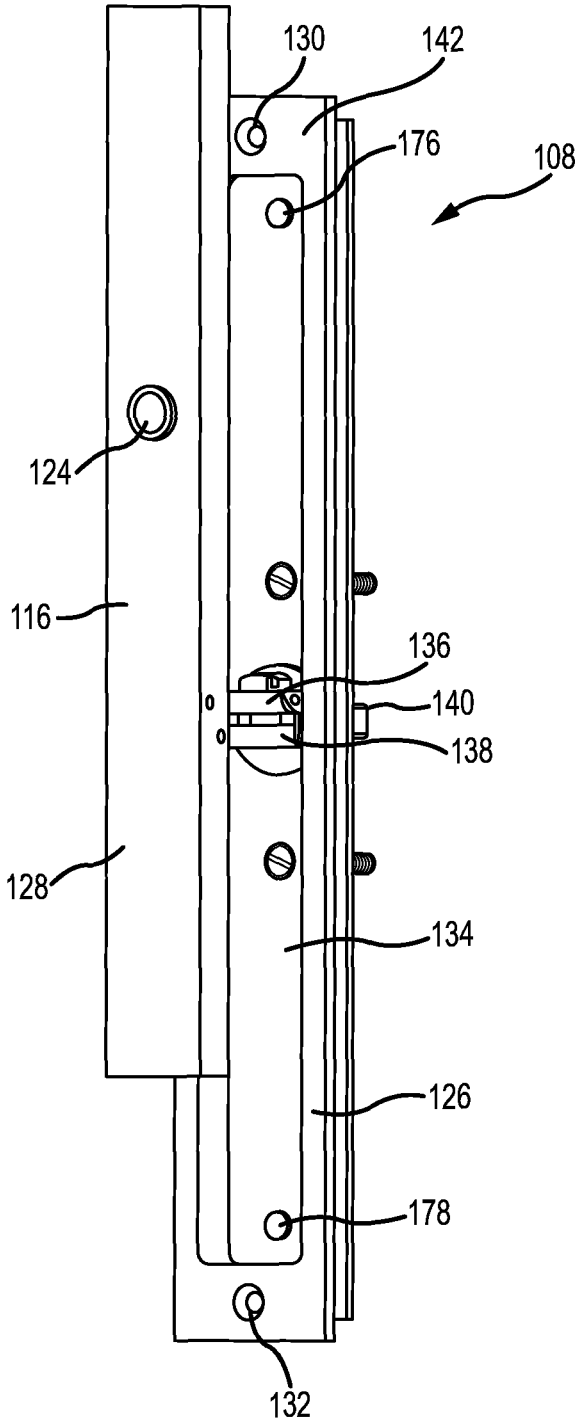
FIG. 3 is an isometric view of the handle assembly with the handle in an actuated position.
Figure 4A:
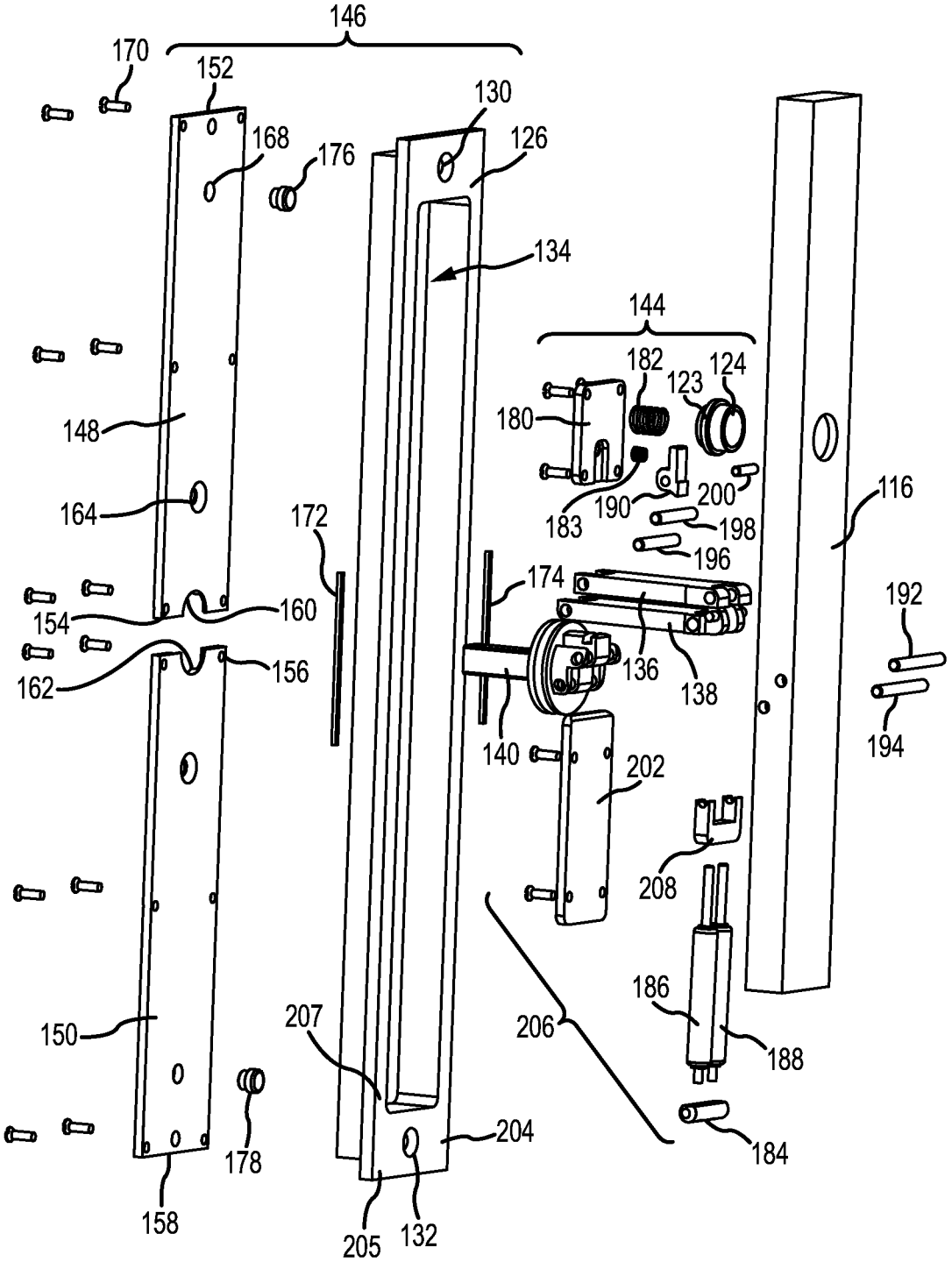
FIG. 4A is a side isometric exploded view of the handle assembly.
Figure 4B:
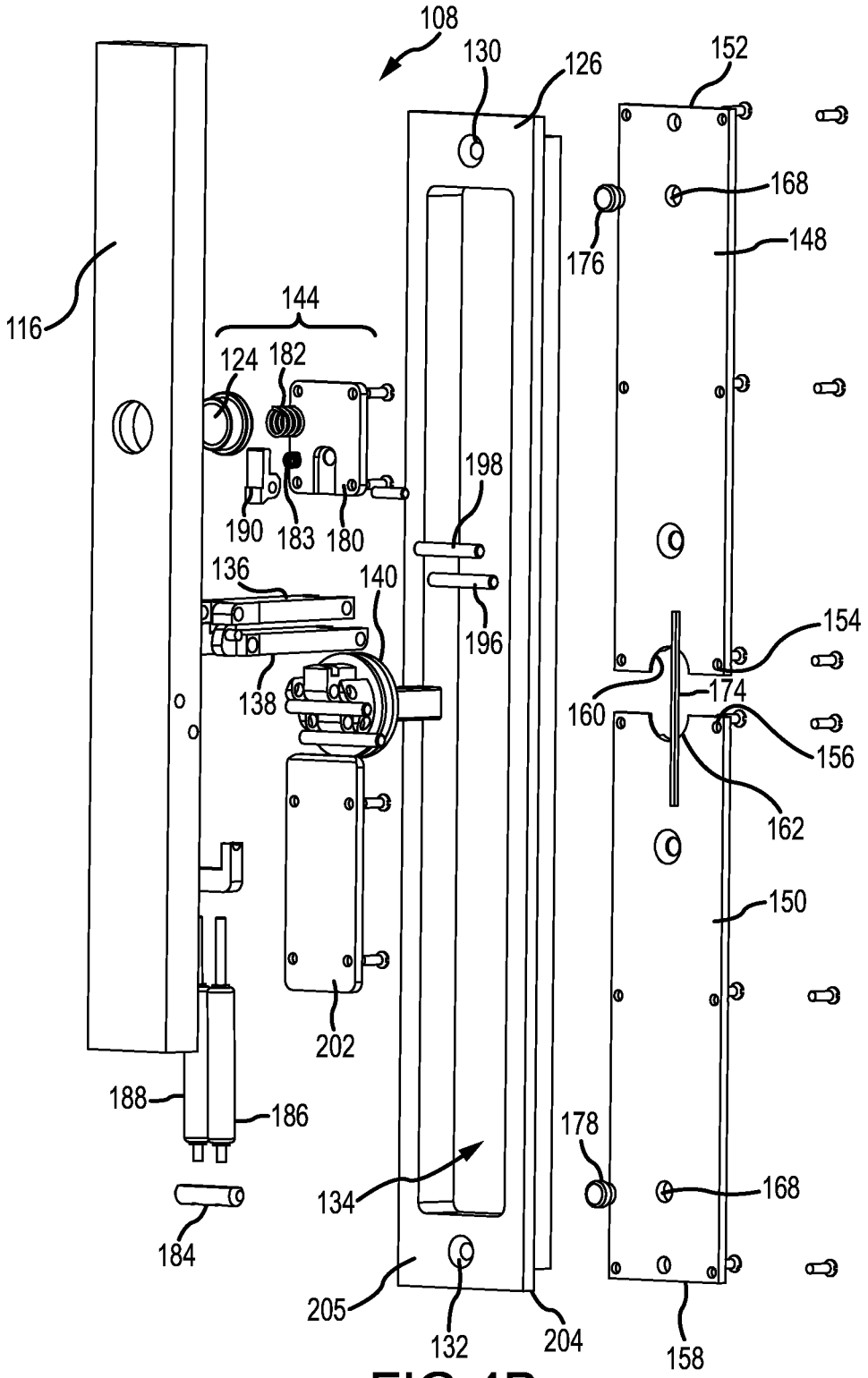
FIG. 4B is another side isometric exploded view of the handle assembly.
Figure 5A:
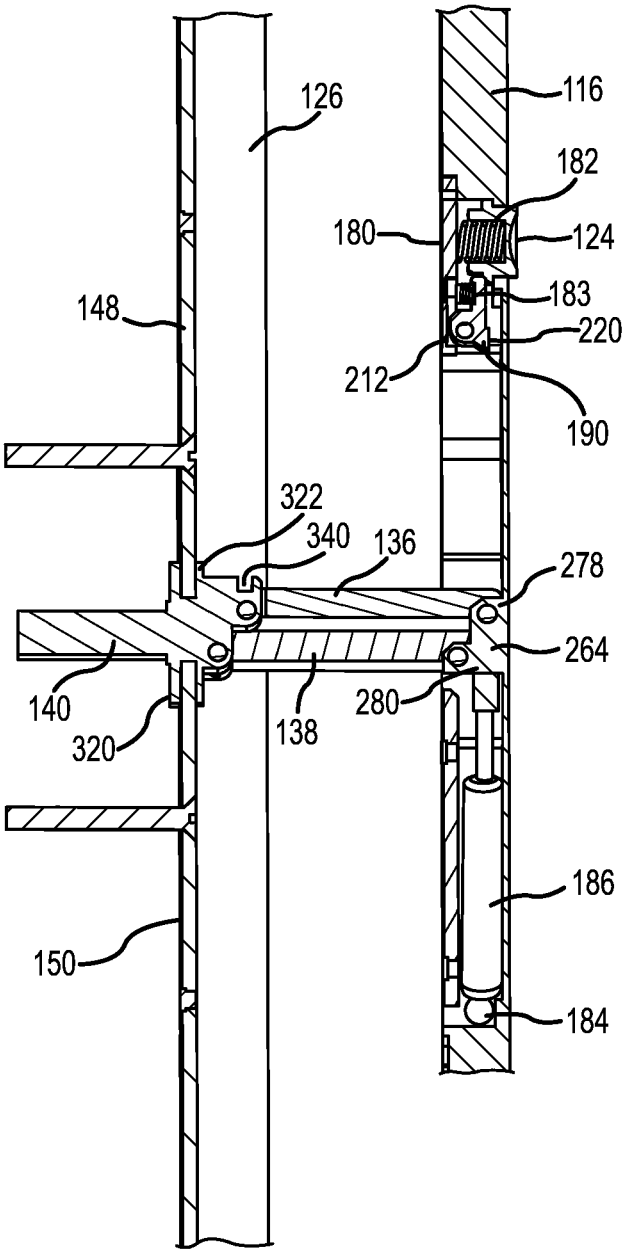
FIG. 5A is a first cross section view of the handle assembly of FIG. 3.
Figure 5B:
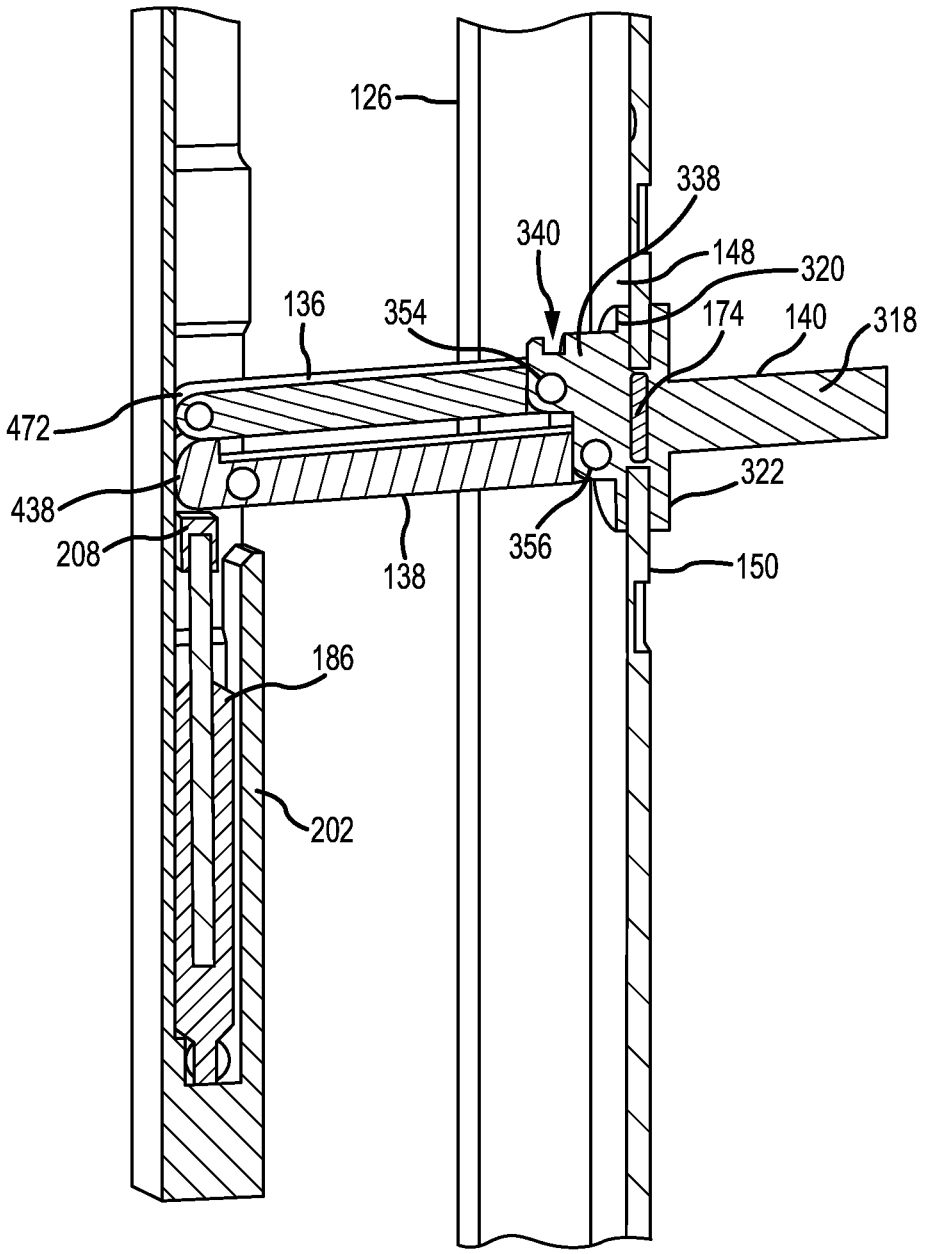
FIG. 5B is a second cross-section view of the handle assembly of FIG. 3.

The handle assembly 108 will now be discussed in more detail. FIG. 3 is a first isometric view of the handle assembly 108 with a handle 116 in the extended position. FIGS. 4A and 4B are exploded views of the handle assembly 108. FIGS. 5A-7 illustrate various cross-sections of the handle assembly 108. With reference to FIGS. 2-7, the handle assembly 108 may include a support assembly 146, the handle 116, an actuation assembly 144, and a biasing assembly 206. Each will be discussed in turn below. The support assembly 146 connects the handle assembly 108 to the master panel 102 and the actuation assembly 144 selectively actuates the biasing assembly 206 to move the handle relative to the support assembly 146.

With reference to FIGS. 4A-5B, the support assembly 146 may include an outer frame 126, a plurality of fasteners 170, one or more back plates 148, 150, one or more support bars 172, 174, and one or more bumpers 176, 178. The outer frame 126 has a frame body 204 and a handle cavity 134 recessed from a top surface 205 of the frame body 204. The handle cavity 134 is sized and shape to correspond to the handle 116, such that the handle 116 can be received into the handle cavity 134. In other words, the handle cavity 134 defines a pocket for the handle 116. As most clearly shown in FIGS. 4A and 4B, a frame lip 207 surrounds the top edge of the handle cavity 134 and extends outwards therefrom. In this manner, the frame lip 207 defines an outer surface of the outer frame 126. As will be discussed below, the frame lip 207 sits on the outer surface of the panel face 114 while the frame body 204 and handle cavity 134 are received into the handle recess 118.

With continued reference to FIGS. 4A and 4B, the frame lip 207 further defines one or more fastening apertures 130, 132. For example, a first fastening aperture 130 may be defined on a first end of the frame lip 207 and a second fastening aperture 132 may be defined on a second end of the frame lip 207. Although two fastening apertures 130, 132 are illustrated, it should be noted that the number and placement of the fastening apertures 130, 132 can be varied as desired. Moreover, in other embodiments the fastening apertures 130, 132 may be omitted and other fastening means may be used to secure the outer frame to the panel.

Figure 8:
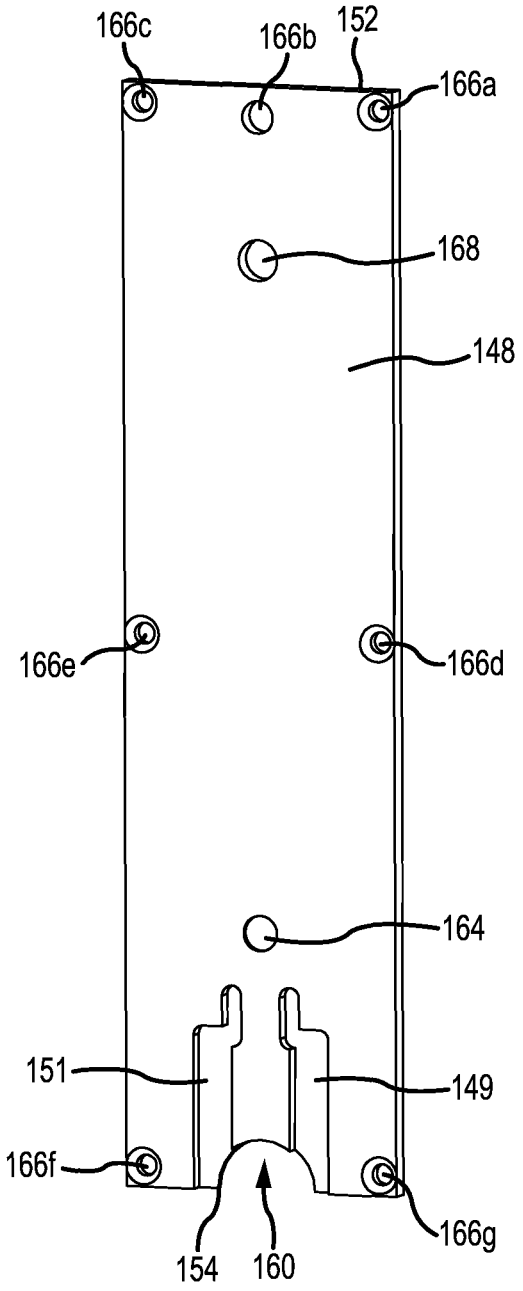
FIG. 8 is a rear isometric view of an upper back plate for the handle assembly.

With reference to FIGS. 4A and 4B, the support assembly 146 includes one or more back plates 148, 150. FIG. 8 is a rear isometric view of an upper back plate. In the embodiment shown in FIGS. 4A and 4B, the support assembly 146 includes an upper back plate 148 and a lower back plate 150. As will be discussed in more detail below, the two back plates 148, 150 are configured to connect to the back side of the frame body 204 to enclose the back end of the frame 126. The upper back plate 148 and the lower back plate 150 may be rectangular shaped and have a width that substantially matches the width of the frame 126 so that they may span across the entire handle cavity opening defined by the frame 126. The upper back plate 148 and the lower back plate 150 may be mirror images of one another, such that the top end of the upper back plate 148 may be substantially the same as the bottom end of the lower back plate 150 and the bottom end of the upper back plate 148 may be substantially the same as top end of the lower back plate 150.

With continued reference to FIGS. 4A, 4B, and 8 the back plates 148, 150 may include a plurality of fastening apertures 166*a*-166*g* configured to receive fasteners to connect the back plates 148, 150 to the frame 126 and/or master panel 102. The size, number, and placement of the fastening apertures 166*a*-166*g* may be varied based on the type of fasteners used, the type of panel, and other design features. In addition to the fastening apertures 166*a*-166*g*, the back plates 148, 150 may each include a bumper aperture 168. The bumper aperture 168 may be defined towards the top and bottom ends 152, 158 of the upper back plate 148 and the lower back plate 150, respectively. However, similar to the fastening apertures, the size, shape, and positioning of the bumper apertures 168 may be modified as desired.

The back plates 148, 150 further each define a hub notch 160, 162. The hub notch 160 on the upper back plate 148 is located at a bottom end of the upper back plate 148 and the hub notch 162 on the lower back plate 150 is located at a top end 156 of the lower back plate 150. With reference to FIG. 8, the back plates 148, 150 may further each include two bar trenches 149, 151. The bar trenches 149, 151 extend longitudinally along a length of the back plate 148, 150. Although the upper back plate 148 is shown in FIG. 8, the bar trenches 149, 151 are substantially the same in the lower back plate 150. The bar trenches 149, 151 are positioned on each back plate towards a center of the plate 148, 150 and on either side of the hub notch 160, 162.

Figure 9:
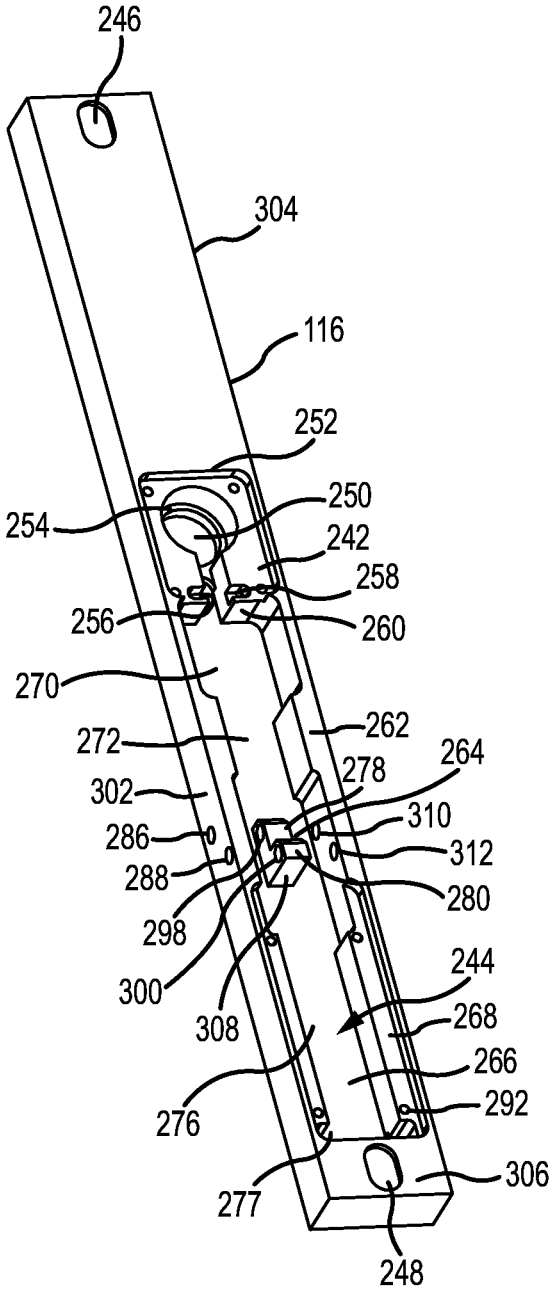
FIG. 9 is a rear isometric view of the handle of the handle assembly.

With reference again to FIGS. 4A and 4B, the handle 116 will now be discussed in more detail. The handle 116 is configured to be gripped by a user and may have a size and shape suited to allow a user to easily grasp the handle 116 to operate the panels 102, 104, 106. FIG. 9 is a rear isometric view of the handle 116. With reference to FIGS. 4A and 9, the handle 116 may have a generally rectangular shape and include a plurality of grooves and features to receive various components of the actuation assembly 144. For example, the handle 116 may include an actuator aperture 250 that extends from the exterior surface 128 of the handle 116 through to the interior surface 306 of the handle 116. The actuator aperture 250 may vary in diameter as it extends through the handle 116. In one embodiment, the diameter of the actuator aperture 250 on the exterior surface 128 has a reduced diameter as compared to the diameter of the actuator aperture 250 on the interior surface 306. In this embodiment, an actuator seat 254 is defined in the actuator aperture 250, reducing the diameter of the actuator aperture 250 at the exterior surface 128 of the handle 116.

With reference to FIG. 9, the handle 116 may also include a cover plate recess 242 defined on the interior surface 306. The cover plate recess 242 surrounds the actuator aperture 250 and is recessed below the interior surface 306 of the handle 116 to define a seat for the cover plate, as will be discussed in more detail below. A pin groove 258 is defined at a lower end 260 of the cover plate recess 242. The pin groove 258 extends laterally across the width of the handle 116. The handle 116 further includes a latch pathway 256 extending from the actuator aperture 250 to a terminal end of the cover plate recess 242. The latch pathway 256 is formed below the interior surface 306 of the handle 116, as well as the top surface of the cover plate recess 242. The latch pathway 256 extends vertically along a length of the handle 116 and is substantially perpendicular to the pin groove 258.

With continued reference to FIG. 9, the handle 116 further defines a storage compartment 244 that defines a cavity to receive select components of the biasing assembly 206. The storage compartment 244 is recessed below the interior surface 306 of the handle 116 and is surrounded by sidewalls 262 that define the shape of the storage compartment 244. The shape and size of the storage compartment 244 may be modified based on the characteristics of the biasing assembly 206. The storage compartment 244 may change in width along a length of the handle 116. Such changes in width may correspond to the features of the components configured to be stored in the particular locations of the storage compartment 244. In one embodiment, the storage compartment 244 may include an upper portion 270 having a first width. The upper portion 270 may narrow to define a neck 272 with a second width. The neck 272 may expand outward to define the body 274 with a third width and the body 274 somewhat narrows to define a trunk 276. The trunk 276 may then expand laterally at the base of the storage compartment 244 to define a mount cavity 277. Each of various sections of the storage compartment 244 may have the same width, different widths, or some sections may have similar widths while others have different widths. For example, the width of the upper portion 270 may be substantially the same as the width of the body 274.

The handle 116 may further include a ledge 268 along the interior surface of the handle 116 adjacent the trunk 276 section of the storage compartment 244. The ledge 268 is recessed below the interior surface 306 but is raised upwards from the bottom surface 266 of the storage compartment 244. A plurality of fastening apertures 292 may be defined on the ledge 268 and extend into the handle 116.

With continued reference to FIG. 9, the handle 116 further may include a plurality of pin apertures 286, 288, 310, 312. In one example, there may four pin apertures 286, 288, two on each of the longitudinal sidewalls 302, 304 of the handle 116. In particular, a first pin aperture 286 and a second pin aperture 288 are defined on a first longitudinal sidewall 302 and a third pin aperture 310 and a fourth pin aperture 312 are defined on a second longitudinal sidewall 304. In this example, the first pin aperture 286 is aligned with the third pin aperture 310 and the second pin aperture 288 is aligned with the fourth pin aperture 312.

The handle 116 also includes a lever island 264 extending upwards from the bottom surface 266 of the storage compartment 244. The lever island 264 is positioned within a center of the storage compartment 244 in the body portion 274, although the lever island 264 may be repositioned as desired. As will be explained in more detail below, the lever island 264 provides a mount and pivot point for select components of the biasing assembly 206. The lever island 264 includes a curved top surface defining a first hump 278 and second hump 280. In one embodiment the first hump 278 is lower than the second hump 280, i.e., the second hump 280 extends further upwards the bottom surface 266 of the storage compartment 244.

With continued reference to FIG. 9, each of the humps 278, 280 include a hump aperture 282, 284 extending laterally through the width of the lever island 264. In this example, the hump apertures 298, 300 extend laterally across the width of the handle 116. The first hump aperture 282 is aligned with the first pin aperture 286 and the third pin aperture 310 defined in the longitudinal sidewall 302, 304 of the handle 116. Similarly, the second hump aperture 284 is aligned with the second pin aperture 288 and the forth pin aperture 312. The lever island 264 may include an end wall 308 that is substantially planar and extends orthogonally from the base of the trunk 276 of the storage compartment.

With continued reference to FIG. 9, the handle 116 may further include a first bumper notch 246 and a second bumper notch 248. The first bumper notch 246 is defined on a first end of the handle 116 and is recessed from the interior surface 306, the second bumper notch 248 is defined on a second of the handle 116 and is also recessed form the interior surface 306. Each of the bumper notches 246, 248 may be generally oval shaped with the longer length of the oval being arranged to extend along the longitudinal length of the handle 116, i.e., parallel to the sidewalls 302, 304. However, the shape and configuration of the bumper apertures 246, 248 may be modified as desired.

Figure 10A:
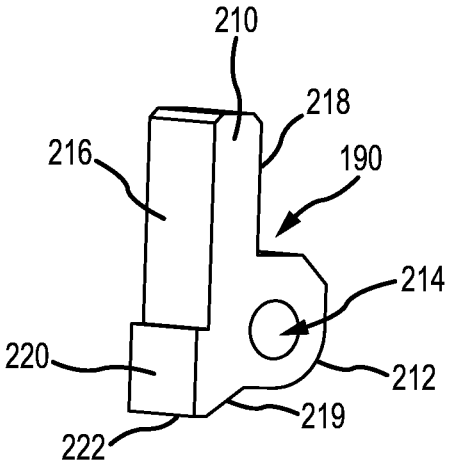
FIG. 10A is a front isometric view of a latch for the handle assembly.
Figure 10B:
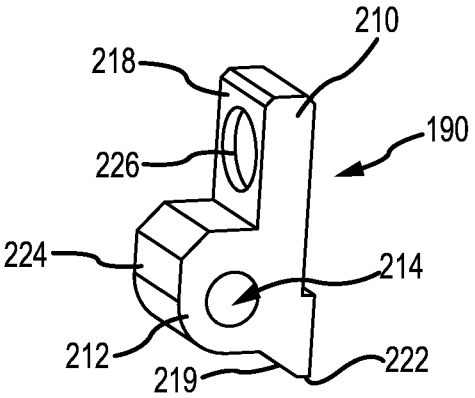
FIG. 10B is a rear isometric view of the latch of FIG. 10A.

The components of the actuation assembly 144 will now be discussed in more detail. As shown in FIGS. 4A and 4B, the actuation assembly 144 may include an actuator spring 182, a latch spring 183, a latch 190, an actuator 124, and an actuator plate 180. FIGS. 10A and 10B illustrate various views of a latch of the actuation assembly 144. With reference to FIGS. 10A and 10B, the latch 190 may be somewhat "b" shaped and include an extension 210 that is somewhat rectangular in shape and a bulging portion 212 that extends outwards from a first portion of the extension 210. In one example, the bulging portion 212 has a curved surface that extends from a bottom end of the extension 210. The bulging portion 212 includes a latch aperture 214 defined therethrough that extends through a center of the bulging portion 212. As most clearly shown in FIG. 10B, the bulging portion 212 may include a faceted surface 224 around the exterior of the bulge 212 extending beyond the curved surface. The faceted surface 224 includes a plurality of substantially planar surfaces extending at different angles around the bulging portion 212.

With reference to FIG. 10A, the latch 190 further includes an abutting surface 220 that extends from a first side 216 of the extension 210. The abutting surface 220 is a substantially planar surface and, because it extends out from the extension 210, it is in a different plane substantially parallel to the plane of the extension 210. With reference to FIG. 10B, a spring recess 226 is defined on the second side 218 of the extension 210. The spring recess 226 is located towards a top end of the latch 190 and is positioned above the bulging portion 212. The spring recess 226 is circular shaped and recessed from the outer surface of the extension 210.

With reference to FIGS. 10A and 10B, a tip 222 is formed at the bottom end of the latch 190. The tip 222 has a triangular cross-section as it extends downward at an angle to define a angled edge 219 from the bottom end of the bulging portion 212 to connect to the abutting surface 220.

Figure 11:
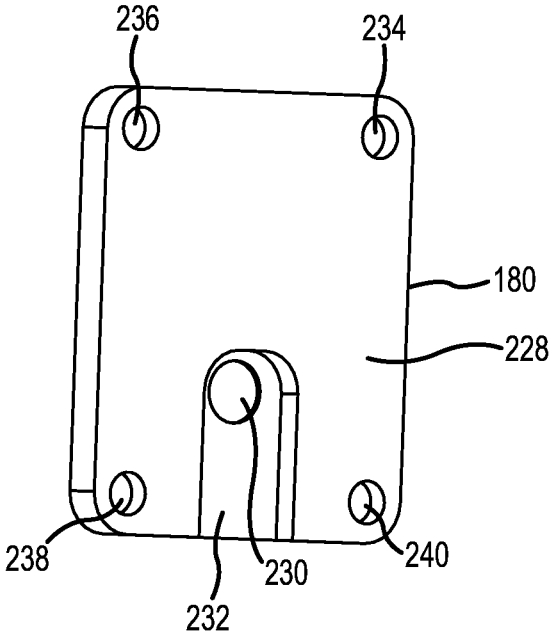
FIG. 11 is an isometric view of an actuator plate for the handle assembly.

The actuation assembly 144 further includes an actuator plate 180. FIG. 11 is an isometric view of the actuator plate 180. With reference to FIG. 11, the actuator plate 180 may be substantially rectangular shaped and may include a plurality of fastening apertures 234, 236, 238, 240. In one example, the actuator plate 144 may include a fastening aperture 234, 236, 238, 240 at each corner such that the actuator plate 144 may include four fastening apertures 234, 236, 238, 240.

With continued reference to FIG. 11, the actuator plate 180 may include a latch recess 232 and spring recess 230 defined on a first side 228. The latch recess 232 is "U" shaped with the open end of the "U" being positioned on the edge of the actuator plate 180 and the remaining portions of the "U" extending towards a center of the actuator plate 180. The spring recess 230 is defined on the closed end of the latch recess 232 and is further recessed from the first side surface 228 of the actuator plate 180 than the latch recess 232.

Figure 12A:
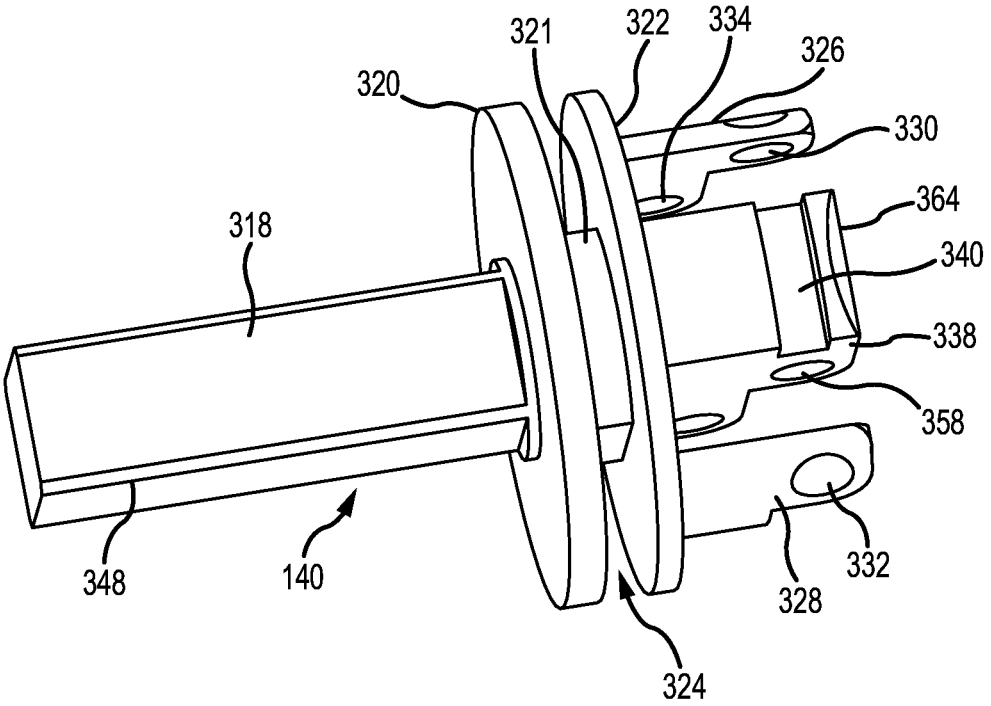
FIG. 12A is a top isometric view of a hub for the handle assembly.
Figure 12B:
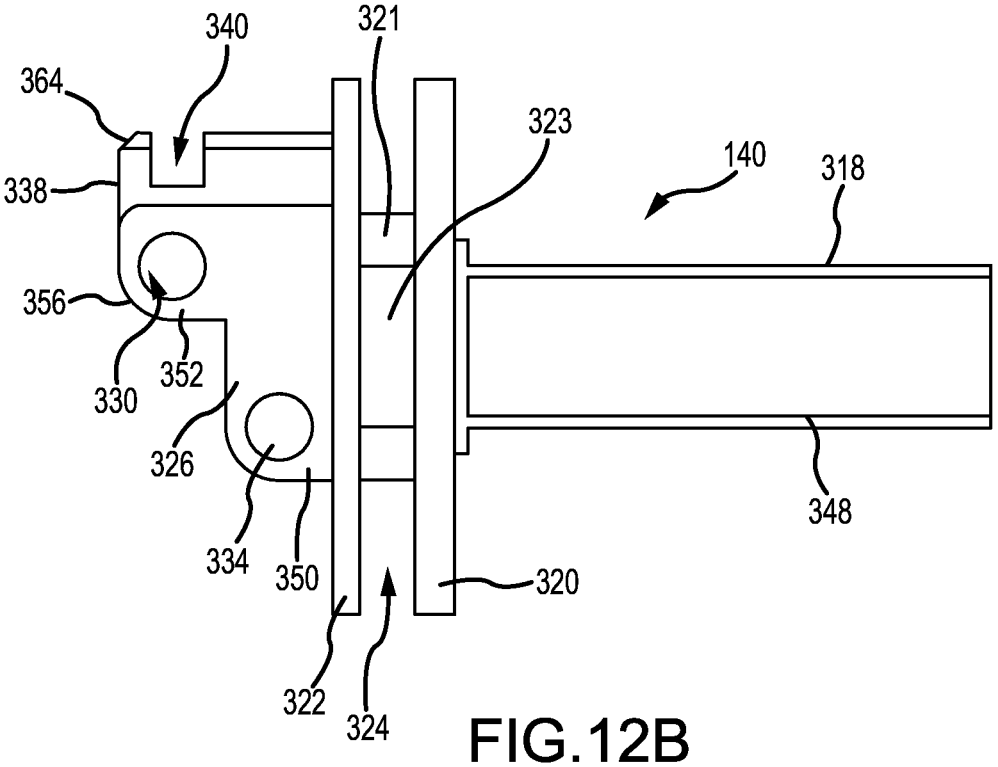
FIG. 12B is a side elevation view of the hub of FIG. 12A.
Figure 12C:
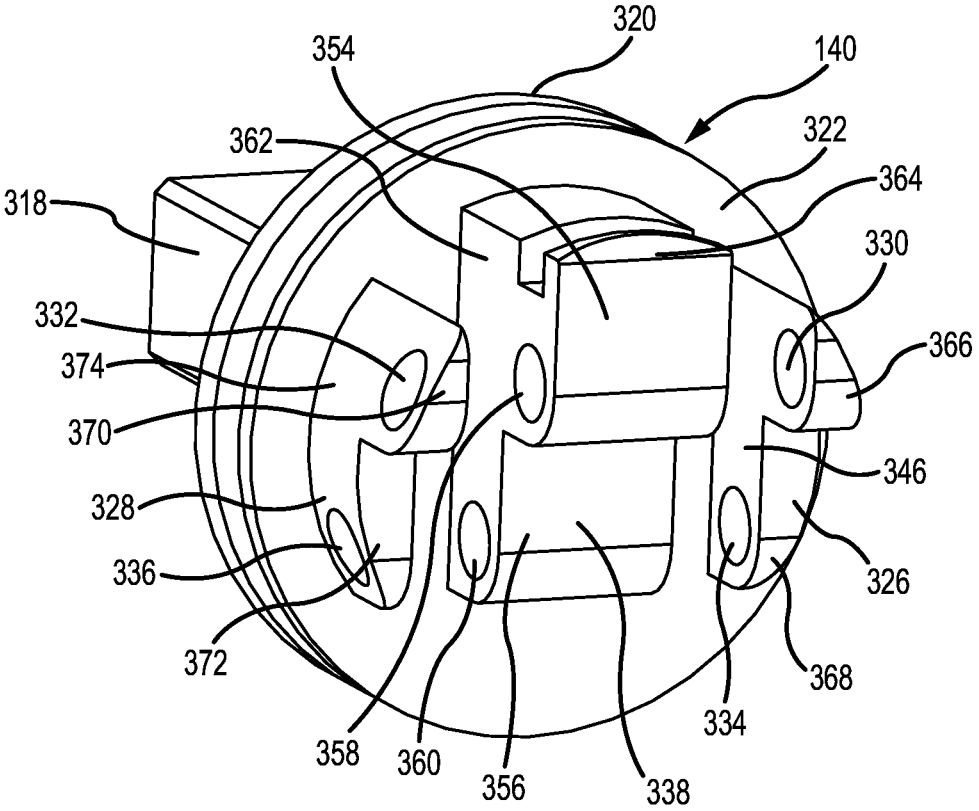
FIG. 12C is a front isometric view of the hub of FIG. 12A.

Select components of the biasing assembly 206 will now be discussed in more detail. FIGS. 12A-12C illustrate various views of the hub. With reference to FIGS. 12A-12C, the hub includes a hub shaft 318 having a substantially square shape in cross-section but includes beveled corners 348. The hub 140 also includes a first flange 320 and a second flange 322. The two flanges 320, 322 are positioned at a first end of the hub shaft 318 and are spaced apart from each other to define an annular groove 324. The two flanges 320, 322 may have the same or substantially the same diameter. However, in some embodiments the first flange 320 may have a slightly larger thickness than the second flange 322. That said, in other embodiments, the flanges 320, 322 may have the same diameters, different diameters, the same thickness, or the second flange 322 may be thicker than the first flange 320. A separation block 321 is positioned between the two flanges 320, 322 and defines the length of the annular groove 324. The separation block 321 may be rounded, or in the embodiments shown in FIG. 12A-12C may include two rounded sides and two flat sides 323, with the rounded sides being positioned on the top and bottom and the flat sides 323 being positioned on the left side and right side of the hub 140.

With continued reference to FIGS. 12A-12C, the hub 140 may further include a pivot mount 338 extending outward from the second flange 322. The pivot mount 338 may include a first lobe 354 and a second lobe 356, with the first lobe 354 extending further outward from the second flange 322 than the second lobe 356. Both the first lobe 354 and the second lobe 356 include a pivot mount aperture 358, 360 defined therethrough, the pivot mount apertures 358, 360 extending laterally through a width of each of the lobes 355, 356.

The top surface of the pivot mount 338 is curved to generally follow the curvature of the second flange 322. Additionally, an engagement channel 340 is defined on the top surface of the pivot mount 338. The engagement channel 340 extends horizontally across the width of the pivot mount 338. An angled surface 364 is defined adjacent to the outer top edge of the engagement channel 340. The angled surface 364 is a relatively planar surface that is oriented at an angle relative to the top surface of the pivot mount 338. In the example shown in FIGS. 12A-12C the angled surface 364 is angled downward and away from the top surface of the pivot mount 338.

Although the top surface of the pivot mount 338 may be curved, the pivot mount 338 may include relatively planar pivot mount sidewalls 362 on either side. The pivot mount sidewalls 362 extend perpendicular to and across a portion of the diameter of the second flange 322.

The hub 140 may further include a first bracket 326 and a second bracket 328 extending on either side of the pivot mount 338 from the second flange 322. The first bracket 326 and the second bracket 328 are substantially mirror images of one another. Each bracket 326, 328 includes a base projection 350 extending outward a first distance from the second flange 322 and a shoulder projection 352 that extends further outward from a portion of the base projection 350. In this manner, the brackets 326, 328 each form an elbow component attached to the second flange 322. The brackets 326, 328 may have curved outer surfaces 374 that generally follow the curvature of the second flange 322. The interior surfaces 346 of the brackets 326, 328 may be flat.

The shoulder projections 352 of the brackets 326, 328 define respective first interface surfaces 366, 270 that face outward from the hub 140. Due to the varying cross-section of the shoulder projections 352, the interface surfaces 366, 370 are substantially triangular shaped and taper from the base projections 350 of the brackets 326, 328 outward toward an edge of the bracket 326, 328. Additionally, second interface surfaces 368, 372 are defined along the outer facing surfaces of the base projections 350 of each of the brackets 326, 328. The second interface surfaces 368, 372 taper from the shoulder projection 352 toward the bottom edge of the base projection 350. In this manner, the tapers of the first interface surface 366, 370 and the second interface surface 368, 372 for each bracket 326, 328 are oriented in different directions.

Each bracket 326, 328 further includes a first bracket aperture 330, 332 defined in the shoulder projection 352 and a second bracket aperture 334, 336 defined in the base projection 350. The first bracket apertures 330, 334 of the first and second brackets 326, 328 are aligned with one another and aligned with the pivot mount aperture 358 defined in the first lobe 354 of the pivot mount 338. Similarly, the second bracket apertures 334, 336 of the first and second brackets 326, 328 are aligned with one another and aligned with the pivot mount aperture 360 defined in the second lobe 356 of the pivot mount 338.

Figure 13A:
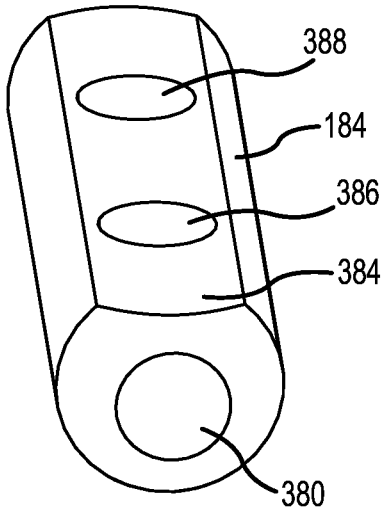
FIG. 13A is a top isometric view of a mount for the handle assembly.
Figure 13B:
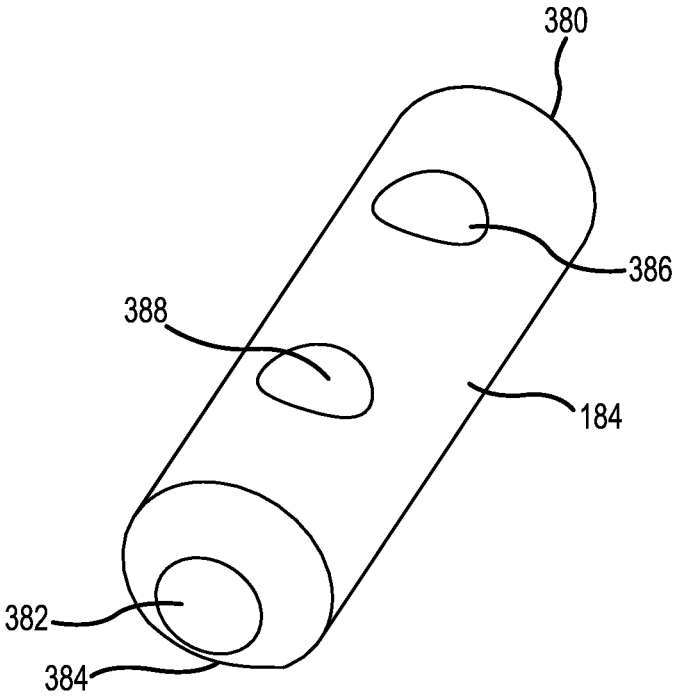
FIG. 13B is a bottom isometric view of the mount of the handle assembly.

Turning now to FIGS. 13A and 13B, a mount for the biasing assembly 206 will now be discussed in more detail. The mount 184 has a substantially cylindrically-shaped body with a flat surface 384 defined on one sidewall of the cylinder. The flat surface 384 extends along the entire length of the mount 184. The ends 380, 382 of the mount 184 are tapered from the sidewalls and include a flat end surface, such that either end of the mount 184 may define a frustum shape. Alternatively, the ends 380, 382 may form convex end curve, with or without the flat end surfaces. The mount 184 further includes a first mounting aperture 386 and a second mounting aperture 388 defined through the flat surface 384 through the width of the mount 184.

Figure 14A:
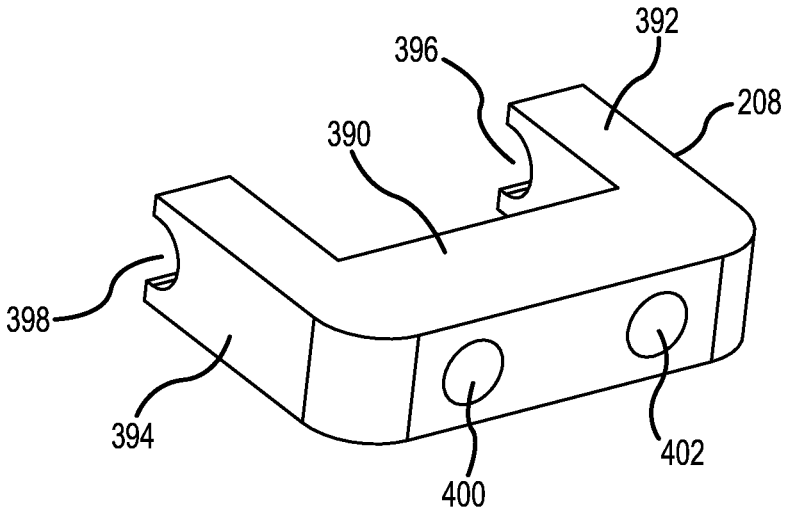
FIG. 14A is a bottom isometric view of a yoke of the handle assembly.
Figure 14B:
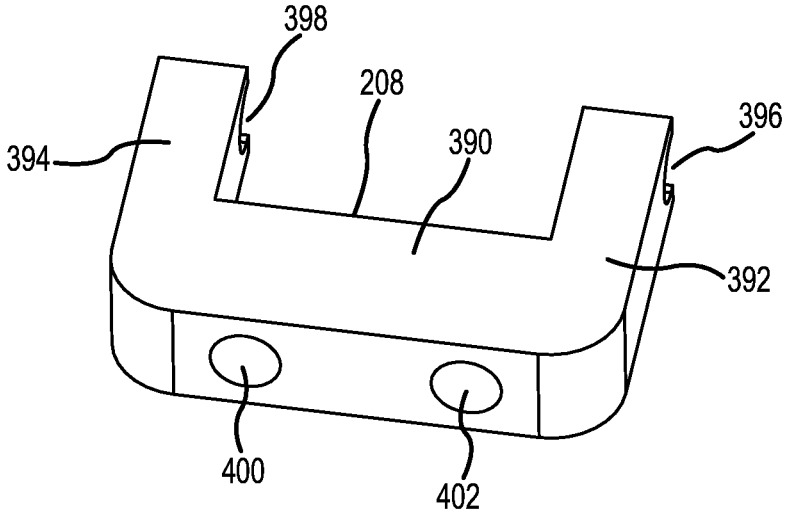
FIG. 14B is another bottom isometric view of the yoke of FIG. 14A.

The biasing assembly 206 may further include a yoke. FIGS. 14A and 14B illustrate top and bottom isometric views of the yoke 208. With reference to FIGS. 14A and 14B, the yoke 208 includes two arms 392, 394 extending at either end from a cross member 390. The yoke 208 further includes a first pivot socket 396 defined on a top surface of the first arm 392 and a second pivot socket 398 defined on a top surface of the second arm 394. The two pivot sockets 396, 398 extend parallel to the cross member 390 and may be aligned with one another.

With continued reference to FIGS. 14A and 14B, the yoke 208 includes a first securing pocket 400 and a second securing pocket 402. The two securing pockets 402, 404 are defined in the bottom surface of the cross member 390 and extend partially through the cross member 390, terminating prior to a top surface of the cross member 390.

Figure 15:
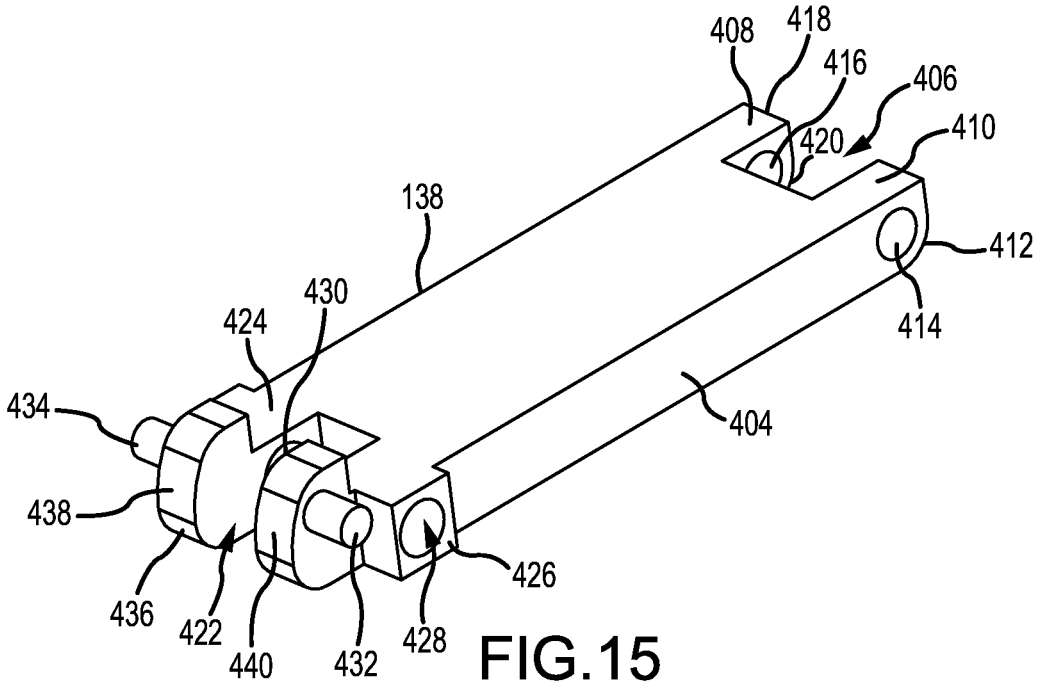
FIG. 15 is a top isometric view of a first lever arm of the handle assembly.
Figure 16:
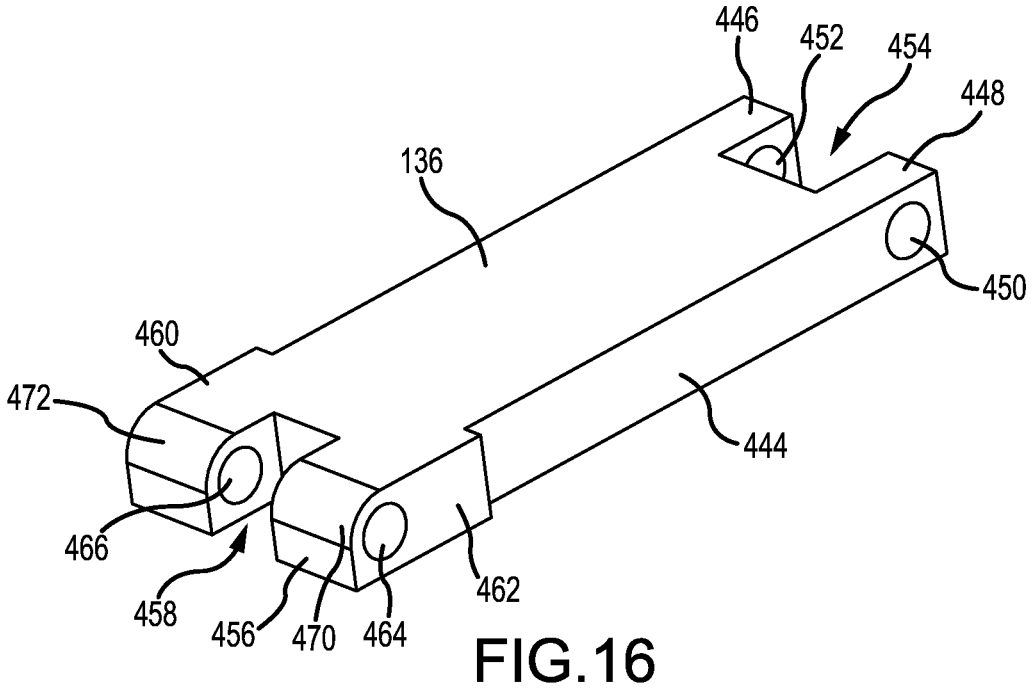
FIG. 16 is a top isometric view of a second lever arm of the handle assembly.

The lever arms for the biasing assembly 206 will now be discussed in more detail. FIG. 15 is a top isometric view of a lower lever arm 138. FIG. 16 is a top isometric view of an upper lever arm. With initial reference to FIG. 15, the lower lever arm 138 includes a main body 404 that extends longitudinally from a first end 418 to a second end 436. The first end 418 of the lower lever arm 138 may include a first cutout 406 defining two arms 408, 410 spaced apart from one another. Each of the arms 408, 410 defined by the first cutout 406 includes a bottom rounded edge 412, 420 and a first hinge aperture 414, 416 defined therethrough. The first hinge apertures 414, 416 are aligned across a width of the arms 408, 410. Similarly, the second end 436 of the lower lever arm 138 includes a second cutout 422 that defines two arms 424, 426 spaced apart from each other by the width of the second cutout 422. Additionally, a base portion of each of the arms 424, 426 on the second end 436 extends laterally outward, wider than the main body 404, in a box shape and defines a second hinge aperture 428, 430 therethrough. The second hinge apertures 428, 430 of the two ends 418, 436 of the lower lever arm 138 extend parallel to and are axially aligned with each other.

With continued reference to FIG. 15, the lower lever arm 138 further includes a first clearance surface 438 and a second clearance surface 440 formed on the ends of arm 424 and arm 426, respectively. The two clearance surfaces 438, 440 define an oblong shaped protrusion from the lower lever arm 138. Each of a pair of pivot pins 432, 434 extends laterally outward from an outer sidewall of each of the clearance surfaces 438, 440. The pivot pins 432, 434 extend parallel to a width of the main body 404 and are axially aligned with each other, but extend further outward than the edges of the main body 404.

With reference now to FIG. 16, the upper lever arm 136 has a main body 444 extending from a first end 456 to a second end 456. Similar to the lower lever arm 138, the upper lever arm 136 includes a first cutout 454 defined at the first end 456, the first cutout 454 defining two arms 446, 448 spatially separated from each other by the first cutout 454. Further, each of the arms 446, 448 also includes a first hinge aperture 450, 452 that extends through the width of the respective arm 446, 448. The first hinge apertures 450, 452 are axially aligned across the cutout 454. The arms 446, 448 of the upper lever arm 136 have relatively straight edges, as compared to the rounded edges 412, 420 of the arms 408, 410 from the lower lever arm 138.

With continued reference to FIG. 16, the upper lever arm 136, includes a second cutout 458 defined on the second end that creates two arms 460, 462 extending outward from the main body 444 and the second end 456 of the upper lever arm 136. The arms 460, 462 include a rounded edge 470, 472 that extends from the top surface of the arms 460, 462 towards the front edge of the upper lever arm 136. Further, each of the arms 460, 462 also defines a second hinge aperture 464, 466 that extends through the width of the respective arm 460, 462. The second hinge apertures 464, 466 are axially aligned with each other.

Assembly of the handle assembly 108 will now be discussed. With reference to FIGS. 4A-8, the various components of the support assembly 146 may be connected together. In one embodiment, the upper back plate 148 and the lower back plate 150 are received into the annular groove 324 defined by the flanges 320, 322 of the hub 140. In particular, the hub notches 160, 162 are inserted into the groove 324 on either side of the hub 140. The edges of the notches 160, 162 abut against the separation block 321. After the hub notches 160, 162 are received into the groove 324, the support bars 172, 174 are received into the bar trenches 149, 151 defined on the back side of the back plates 148, 150. For example, the support bars 172, 174 can be threaded between the back plates 148, 150 and the first flange 322. The flange 322 helps to keep the supports bars 172, 174 in position and the support bars 172, 174 provide extra strength and rigidity to the back plates 148, 150.

The bumpers 176, 178 are received into the bumper apertures 168 in each of the back plates 148, 150. The frame 126 and the back plates 148, 150 are then connected together by the fasteners 170 received into the various fastening apertures 166*a*-166*g* in the back plates 148, 150 as well as into the frame 126 itself.

With reference to FIGS. 4A-7 and 9, the actuation assembly 144 may be assembled by inserting the actuator 124 into the actuator aperture 150. The actuator 124 may include an annular flange 123 (see FIG. 7) that seats on the actuator seat 254, preventing the actuator 124 from falling out of the actuator aperture 150 from the front of the handle 112. The actuator spring 182 is then positioned in a cavity within the actuator 124. The pin 200 is then received through the latch aperture 214 in the latch 190 and the latch is received in the latch pathway 256 on the interior of the handle 116. The pin 200 is positioned in the pin groove 258 in the handle 116 and the latch extends below the end 260 of the plate recess 242. The latch spring 183 is then positioned partially within the spring recess 226 defined in the extension 210 of the latch 190. The spring recess 226 helps to hold the latch spring 183 in position and prevent lateral and/or vertical movement of the latch spring 183 relative to the extension 210.

The actuator plate 180 is then positioned into the plate recess 242 and the fasteners are inserted into each of the fastening apertures 234, 236, 238, 240 to secure the actuator plate 180 to the handle 190. The actuator plate 180 is aligned with the actuator spring 182 such that the spring seats in the spring recess 230 and the extension 210 of the latch 190 seats within the latch recess 232 of the actuator plate 180.

With reference to FIGS. 4A-7 and 17A, to connect together various components of the biasing assembly 206, the upper lever arm 136 and the lower lever arm 138 are connected to the hub 140. In particular, the pivot mount 338 is positioned within the first cutout 454 of the upper lever arm 136 and the arms 446, 448 are received between the pivot mount 338 and the brackets 326, 328. Similarly, for the lower lever arm, the first cutout 406 is received around the pivot mount 338 and the arms 408, 410 are received between the pivot mount 338 and the brackets 326, 328. Once both lever arms 136, 138 in position, a first pin 198 is received through the first bracket aperture 330, through hinge aperture 450 of the upper lever arm 136, through the pivot mount aperture 358, through hinge aperture 452 of the upper lever arm 136, and through the bracket aperture 332 on the second bracket 328. The pin 198 secures the upper lever arm 136 to the hub 140. Similarly, a second pin 196 is received through the bracket aperture 334 in the first bracket 326, through hinge aperture 414 on the lower lever arm 138, through the pivot mount aperture 360 of the pivot mount 338, through the hinge aperture 416 of the lower lever arm 138, and through the bracket aperture 336 in the second bracket 328. The second pin secures the lower lever arm 138 to the hub 140.

Once the lever arms 136, 138 are connected to the hub 140, the lower lever arm 138 is connected to the yoke 208. In particular, the first pivot pin 432 is positioned in the first pivot socket 396 and the second pivot pion 434 of the lower lever arm 138 is positioned in the second pivot groove 398 of the yoke 208. The pivot sockets 396, 398 are configured to allow the pivot pins 432, 434 to rotate within the sockets.

With the yoke 208 connected to the lower lever arm 138, the biasing members 186, 188 are received into the first securing pocket 400 and second securing pocket 402, respectively, of the yoke 208. For example, the biasing members 186, 188 may include cylindrical posts that fit within the pockets 400, 402 to connect the biasing members 186, 188 to the yoke 208. Similarly, the bottom ends of the biasing members 186, 188 may also include securing posts that can be received into the mount 184 and specifically into the first and second mounting apertures 386, 388.

After the components of the biasing assembly 206 are connected together, the biasing assembly 206 is positioned in the storage cavity 244 for connection to the handle 112. For example, with reference to FIGS. 4A-7, 9, and 17A, the mount 184 is positioned into the mount cavity 277, the biasing members 186, 188 and yoke 208 are received in the trunk 276, the upper and lower lever arms 136, 138 connect around the island 264, and the end of the hub 140 is positioned in the upper portion 270.

The first hump 278 of the island 264 is received into the second cutout 458 of the upper lever arm 136 and the second hinge apertures 464, 466 of the upper lever arm 136 are aligned with the first pin aperture 286, third pin aperture 310, and first hump aperture 298. Once the arm 136 is aligned with the island 264 and apertures, the pin 192 is inserted into the pin apertures 286, 298, 310, 464, 466 to connect the upper lever arm 136 to the handle 112. Similarly, the second hump 208 is received into the second cutout 422 of the lower lever arm 138. The second hinge apertures 428, 430 of the lower lever arm 138 are aligned with the second pin aperture 298 and fourth pin aperture 312 of the handle 112 and the second hump aperture 300 of the island 264. After the alignment pin 194 is received through the second pin aperture 298, the hinge aperture 428, the second hump aperture 300, the hinge aperture 430, and the fourth aperture 312 to connect the lever arm 138 to the handle 112. Once positioned in the storage compartment 244, a cover plate 202 is connected over the storage compartment and seats on the edge 268. Fasteners then secure the cover plate 202 to the handle 112. It should be noted that in some embodiments, the cover plate 202 may only cover a portion of the storage compartment 244. For example, in the embodiments shown in FIGS. 4A-7, the cover plate 202 may be configured to only cover the biasing members 186, 188, mount 184, and optionally the yoke 208. This configuration allows the lever arms 136, 138 to rotate/move without hindrance. However, in other embodiments, the cover plate 202 may enclosure more or fewer components of the handle assembly.

Figure 6:
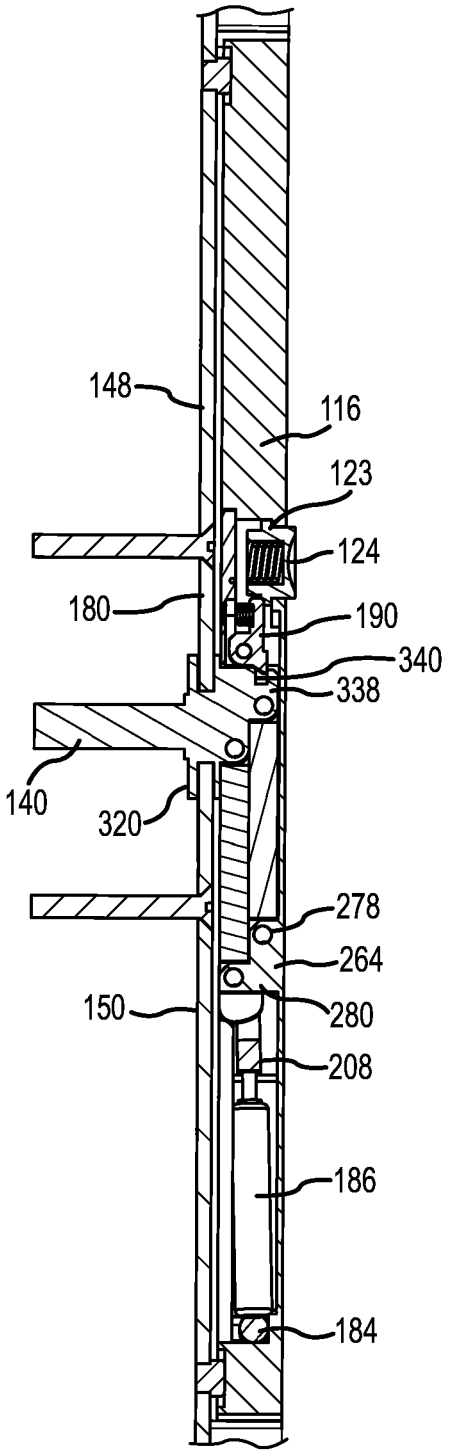
FIG. 6 is cross-section view of the handle assembly taken along line 6-6 in FIG. 2.
Figure 7:
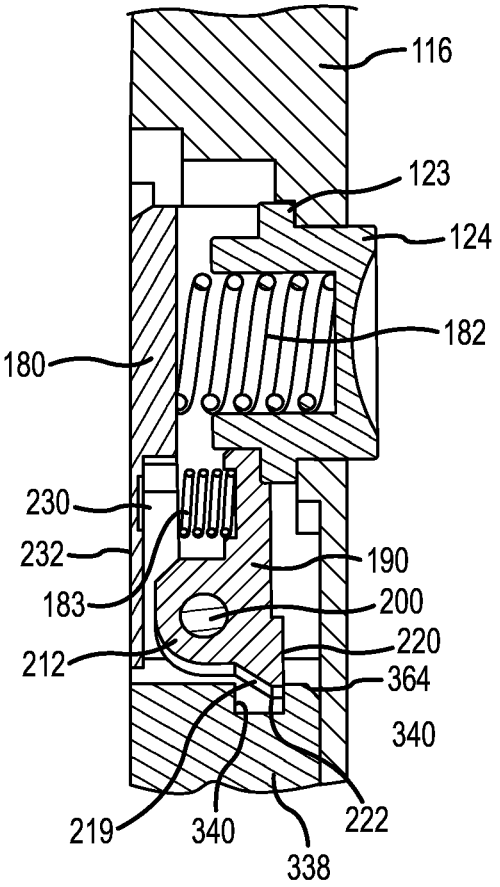
FIG. 7 is an enlarged view of FIG. 6 illustrating the actuation assembly.

Operation for the handle assembly 108 will now be discussed in more detail. With reference to FIGS. 2, 6, and 7, in the closed or nested position, the handle 112 is positioned in the handle cavity 134 of the frame 126. To operate any of the panels 102, 104, 106, the user selects the actuator 124. For example, the actuator 124 may be a button or other compressible switch, and the user presses the actuator 124 causing the actuator 124 to compress the actuator spring 182. As the actuator spring 182 compresses, the flange 123 of the actuator 124 engages the extension 210 of the latch 109. The engagement between the actuator 124 and the latch 190, causes the latch 190 to pivot. As the latch 190 pivots, the latch spring 183 is compressed by the extension 210 and the tip 222 moves out of the engagement groove 340 of the pivot mount 338 on the hub 140 toward the interior surface 306 of the handle 112. The angled surface 219 of the tip 222 aids in providing clearance to disengage the tip 222 from the groove 340.

Once the tip 222 is disengaged, a biasing force exerted by the biasing members 186, 188 is no longer constrained by the latch 190. The biasing members 186, 188 may be mounted at a slight angle relative to the handle 116. (See FIGS. 5A and. 6 illustrating the biasing members 186, 188 oriented at an angle toward the back plates 148, 150). The pivot pins 432, 434 are positioned off-center with respect to the pivot point defined at pin 194 that connects the lower lever arm 138 to the handle 116 via the lever island 264. The biasing members 186, 188 push against the pivot pints 434, 436 on the arms 424, 426 and the pin 194 becomes a fulcrum about which the lower lever arm 138 pivots. The lower lever arm 138 continues to pivot until the arms 392, 394 of the yoke 208 interface with the box-shaped, base portion of each of the arms 424, 426 of the lower lever arm 138 to provide a positive stop to the extension of the handle 116. The upper lever arm 136 travels in tandem with the lower lever arm 138.

Figure 17A:
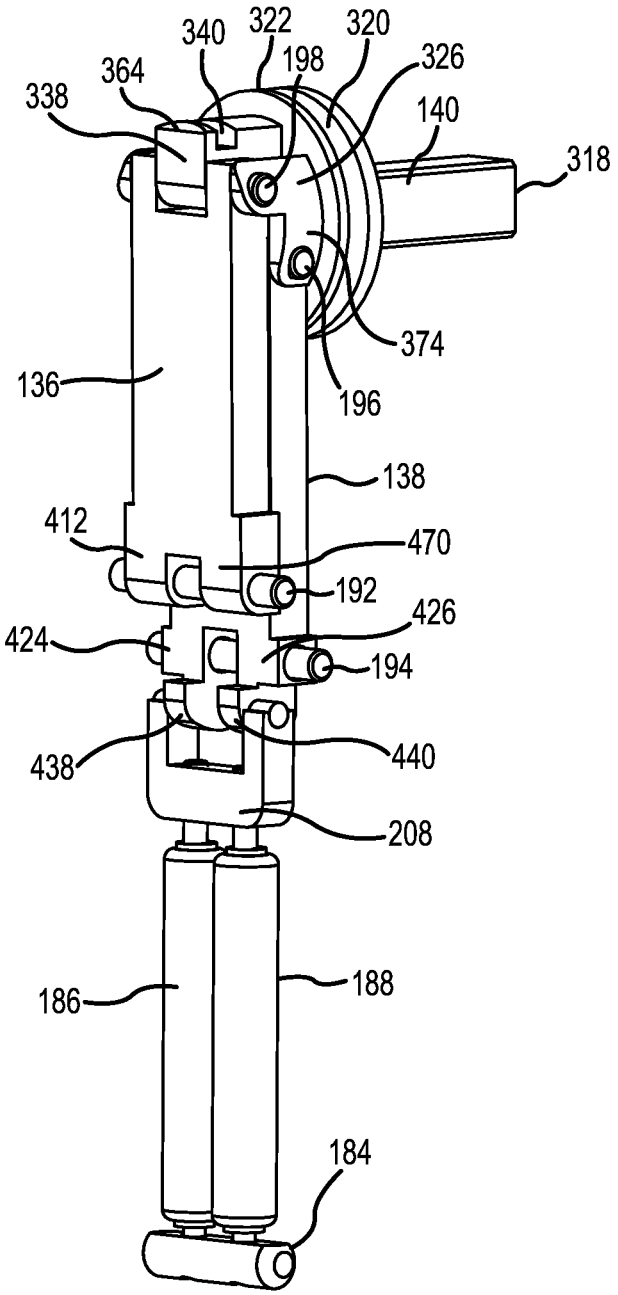
FIG. 17A is an isometric view of the biasing assembly of the handle assembly with select elements hidden for clarity, with the handle being in the closed position.
Figure 17B:
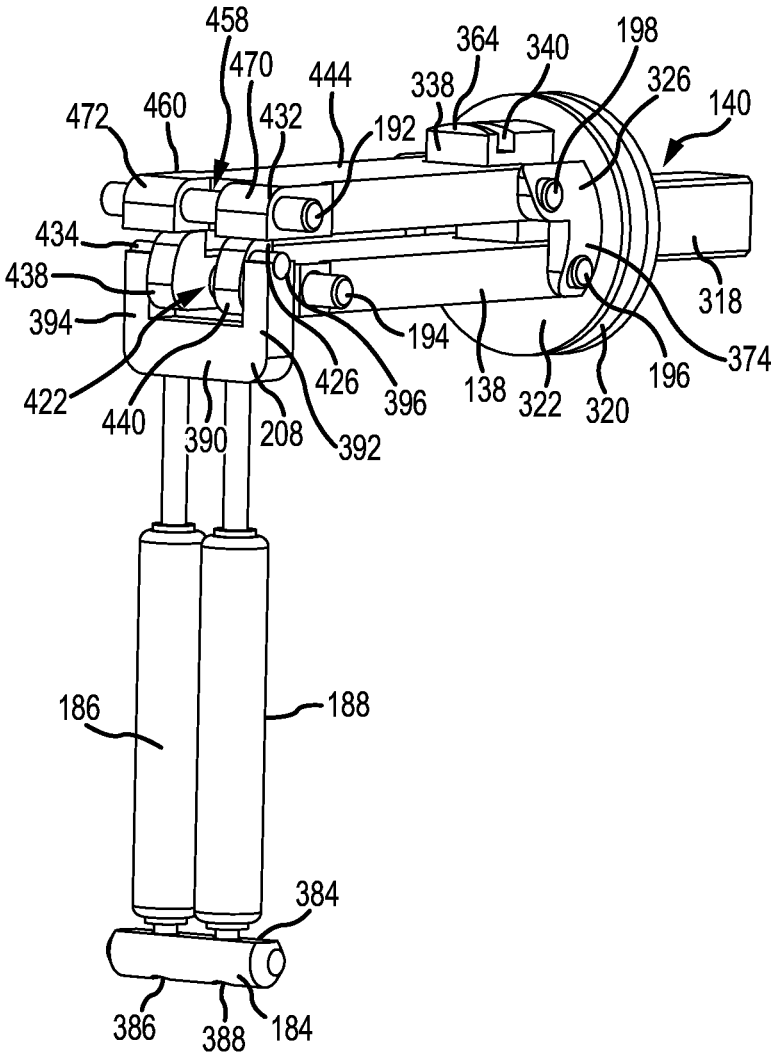
FIG. 17B is an isometric view of the biasing assembly similar to FIG. 17A but with the handle being in the actuated position.

The pivot pins 432, 434 rotate within the sockets 396, 398 in the yoke 208 and the clearance surfaces 438, 440 travel through the yoke 208 without interference. As the pins 432, 434 rotate, the clearance surfaces 438, 440 travel between the arms 392, 394 of the yoke 208. The shape and configuration of the clearance surfaces 438, 440 provides clearance between the top surface of the cross member 390 of the yoke 208 to allow the lever arm 138 to move without interference with the cross member 390. With reference to FIG. 17B, as the pins 438, 440 pivot, the clearance surfaces 438, 440 move between the arms 392, 394 of the yoke 208 and the lever arms 136, 138 move from a substantially parallel orientation relative to the biasing members 186, 188 to a substantially perpendicular orientation. The lever arms 136, 138 are anchored to the frame 126 by the hub 140 and so the movement of the lever arms 136, 138 causes the handle 116 to move outward and upwards with the lever arms 136, 138.

As noted, the upper lever arm 136 may be configured to follow the movement of the lower lever arm 138 due to its connection to the hub 140 and handle 116. The upper lever arm 136 provides additional strength to the handle linkage. After the lever arms 136, 138 have completed their movement from the substantially parallel orientation relative to the handle 116 to the substantially perpendicular orientation, the handle 116 is in the actuated position.

As will be discussed below, the handle 116 may be actuated regardless of orientation, i.e., either stowed in a first position within the handle cavity 134 with the actuator 124 located in a top half of the handle 116 relative to the frame 126 or in a second, rotated position with the actuator 124 located in a bottom half of the handle 116 relative to the frame 126. In either orientation, the actuation operation will be the same.

Once actuated, the user may rotate the handle 112 to engage the door panel 102 with the track 110. For example, the user may rotate the handle by 180 degrees. As the user exerts a rotation force on the handle 112, the lever arms 136, 138, which are rigidly connected to the handle 116 through the lever island 264, also rotate. The lever arms 136, 138 exert a force on the hub 140, which causes the hub 140 to rotate in the cavity defined by the notches 160, 162 in the back plates 148, 150. Specifically, the separation block 321 rotates within the cavity defined by the hub notches 160, 162 of the back plates 148, 150 while the hub 140 is retained against the back plates 148, 150 by the flanges 320, 322. This allows the hub 140 to rotate, while still remaining secured to the respective panel 102, 104, 106 via the frame 126. The hub 140 and specifically the hub shaft 318 are configured to connect with a conventional lift and slide hardware system that actuates the lift and slide function of the door system 100. For example, as the handle 116 is rotated, the hub shaft 318 rotates a mechanical structure (not shown) in the door 102, to lift the door 102 onto the track 110 and engage the low friction mechanism (e.g., bearing) with the track 110. When actuated, the handle 116 extends from the panel 102 to provide a lever arm to decrease the force required by the user to engage the lift and slide mechanism to lift the panel 102 onto the track 110. This allows a user to minimal force in order to move the handle 102.

Once the handle 116 has been rotated and the door 102 has been lifted onto the track 110 by the lift and slide mechanism within the door 102, the user may use the handle 116 to slide the panel 102 along the track 110. The user may configure the remaining panels 104, 106 for movement along the track 110 by actuating the handles 116 on each panel 104, 106 and engaging the panels with the track 110 in the same manner as described above with respect to the first panel 102. Once the slave panels 104, 106 are lifted onto the track, the handles 116 for the slave panels 104, 106 may be pressed into their respective frames 126 and latched into a flush position to allow the slave panels 104, 106 to slide past each other and to allow the master panel 102 to slide past the slave panels 104, 106 as well, As noted, the user can push the handle 112 back into the handle cavity 134 into the nesting position. To do this, the user exerts a force that overcomes the biasing force exerted by the biasing members 186, 188. The force causes the lever arms 136, 138 to move and the pivot pins 432, 434 to rotate within the pin sockets of the yoke 208. As the pins rotate, the lever arms 136, 138 pivot on the respective hinge pins to return to the parallel orientation relative to the biasing members 186, 188 and the handle 112. In the parallel orientation, the latch 190 engages with the engagement groove 340 of the pivot mount 338. In particular, the angled wall 364 on the prong 338 of the hub 140 directs the latch 190 over the prong 338 to fall into position in the engagement groove 340. After the latch 190 is received into the groove 340, the lever spring 138 biases the latch 190 in place to secure the handle 116 in the nested position. Once the latch 190 is positioned in the groove 340, the biasing members 186, 188 are forced to remain in the storage cavity and the handle 116 can be positioned in the handle cavity 134 of the frame 126. The bumpers 176, 178 engage the bumper notches 246, 248 on the interior surface 306 of the handle 116, and help to direct the handle 116 into the cavity 134, as well as provide haptic feedback to the user to indicate when the handle 116 is positioned and locked into the cavity 134.

When the handle 116 is received in the handle cavity 134, the exterior surface 128 of the handle 116 may be substantially flush with the outer surface of the panel 102. This helps to prevent the handle 116 from interfering with the storage of the panel 102, allowing the panel 102 to be stored in a pocket, as well as allowing the master door 102 to slide adjacent to the slave door 104.

When the panels 102, 104, 106 are engaged on the track 110, the handle 116 will be received in the handle cavity 134 upside down. In other words, the top end of the handle 116 will be oriented towards a bottom end of the frame 126 and the bottom end of the handle 116 will be oriented towards a top end of the frame 126. As the handle 116 can be nested into the frame 126 in either the upright or the upside down orientations, the handle 116 is able to be recessed into the panel 102, 104, 106 without disengaging the panels from the track 110. In other words, the handle 116 can be nested without rotating the hub 140, so that the hub 140 does not engage the lift and slide mechanism in the door panel 102, 104, 106.

In the upside down nested orientation, the handle 116 can still be actuated to extend outwards from the handle cavity 134. This is because the biasing assembly, linkage, and actuation assembly rotate with the handle 116, so that these components remain in the same orientation relative to each other. It is only the orientation of the support assembly that varies relative to the other components. In fact, in the upside down nested position, the user actuates the handle 116 by pressing on the actuator 124 as described above. After the handle 116 extends outwards, as also described above, the handle 116 will be upside down relative to the frame 126 and the user can then grip the handle 116 to move the panel.

If the user wishes to close the panels 102, 104, 106, the user actuates the handle 116 of the particular panel to cause the handle 116 to extend outwards. The user then grasps the handle 116 to pull the respective panel 102, 104, 106 along the track 110 into a desired position. Once the doors are in the desired location, the user rotates the handle 116 another 180 degrees. Rotation of the handle 116 causes the hub 140 to rotate via the connection of the handle 116 to the lever arms 136, 138 and the lever arms 136, 138 connection to the hub 140. As the hub 140 rotates, the hub shaft 318 selectively actuates the lift and slide mechanism (not shown) in the door panel 102. This actuation causes the panel 102 to disengage from the track 110 and lower towards the floor. The panels 102, 104, 106 then engage the weather stripping (if any), or the top surface of the floor within the opening 112 of the structure 109. When the panels 102, 104, 106 are lowered, the user then nests the handle 116 in the upright orientation by pressing on the handle 116 sufficiently to overcome the biasing force of the biasing members 186, 188. The nesting operation is the same as described above with respect to the upside down nested position, except that in this orientation, the handle 116 will be upright when it is received into the frame 126.

The handle assembly 108 provides for symmetrical operation, which allows the handle 116 to be nested and actuated to the extended position in both an upright and an upside down position. As described above, the symmetrical operation is provided due to size of the handle 116 and the position and connection of the lever arms 136, 138 and latch 190 relative to each other. In particular, as the handle 116 rotates, the latch 190 rotates, and the hub 140 rotates the engagement groove 340 therewith. Thus, the latch 190 and the engagement groove 340 are in the same position relative to each other, regardless of the position of the handle 116 relative to the frame 126 and/or panel 102.

Conclusion

All directional references (e.g., proximal, distal, upper, lower, upward, downward, left, right, lateral, longitudinal, front, back, top, bottom, above, below, vertical, horizontal, radial, axial, clockwise, and counterclockwise) are only used for identification purposes to aid the reader's understanding of the present invention, and do not create limitations, particularly as to the position, orientation, or use of the invention. Connection references (e.g., attached, coupled, connected, and joined) are to be construed broadly and may include intermediate members between a collection of elements and relative movement between elements unless otherwise indicated. As such, connection references do not necessarily infer that two elements are directly connected and in fixed relation to each other. The exemplary drawings are for purposes of illustration only and the dimensions, positions, order and relative sizes reflected in the drawings attached hereto may vary.

The above specification, examples and data provide a complete description of the structure and use of exemplary embodiments of the invention as defined in the claims. Although various embodiments of the claimed invention have been described above with a certain degree of particularity, or with reference to one or more individual embodiments, those skilled in the art could make numerous alterations to the disclosed embodiments without departing from the spirit or scope of the claimed invention. Further, in methodologies directly or indirectly set forth herein, various steps and operations are described in one possible order of operation but those skilled in the art will recognize the steps and operation may be rearranged, replaced or eliminated without necessarily departing from the spirit and scope of the claimed invention. Other embodiments are therefore contemplated. It is intended that all matter contained in the above description and shown in the accompanying drawings shall be interpreted as illustrative only of particular embodiments and not limiting. Changes in detail or structure may be made without departing from the basic elements of the invention as defined in the following claims.

What is claimed is:

1. A handle assembly for use with a lift and slide door system, the handle assembly comprising a support frame configured to be received within a recess defined within a surface of a door panel wherein a furthest outer surface of the support frame is configured to be substantially flush with the surface of the door panel;

a handle rotationally and movably connected to the support frame;

a hub rotationally connected to the support frame, and a first lever arm pivotably connected to the handle at a first end and pivotably connected to the hub at a second end; wherein in a first position the handle is substantially flush with the surface of the door panel, the first lever arm is substantially parallel to the surface of the door, and the handle selectively locks to the hub to prevent movement of the handle; and in a second position the handle extends from the surface of the door, the first lever arm is substantially perpendicular to the outer surface of the door, and rotation of the handle rotates the hub relative to the support frame.

2. The handle assembly of claim 1, wherein the handle forms a lever for use by a user to rotate the hub and thereby operate a lift and slide mechanism in the door panel.

3. The handle assembly of claim 1 further comprising a second lever arm substantially parallel to the first lever arm and pivotably connected to the hub at a first end and pivotably connected to the handle at a second end.

4. A handle assembly comprising a support assembly configured to connect to a door panel;

a lever arm pivotably connected to the support assembly;

a handle movably connected to the support assembly by the lever arm, wherein the handle moves from a first position nested within the support assembly and flush with an outer surface of the support assembly to a second position spaced apart from the support assembly; and a biasing assembly mounted entirely within the handle and configured to selectively move the handle from the first position relative to the support assembly to the second position relative to the support assembly.

5. The handle assembly of claim 4 further comprising an actuating assembly connected to the handle, wherein in response to a user force the actuating assembly releases the handle from a latched state in the first position allowing the biasing assembly to move the handle from the first position to the second position.

6. The handle assembly of claim 5, wherein the support assembly further comprises a frame configured to be received into a recess within the door panel; and at least one back plate secured to the frame; wherein the frame and the at least one back plate define a handle cavity; and in the first position the handle is nested in the handle cavity; and a hub rotatably connected to the back plate and connected to the lever arm such that as the handle rotates the hub rotates therewith up to at least 180 degrees.

7. The handle assembly of claim 6, wherein the biasing assembly comprises a biasing member connected to the handle; and the lever arm is pivotably connected to the biasing member and pivotably connected to the hub, wherein the biasing member imparts a bias force on the lever arm.

8. The handle assembly of claim 7, wherein the lever arm is substantially parallel to the handle when the handle is in the first position; and the lever arm is substantially perpendicular to the handle when the handle is in the second position.

9. The handle assembly of claim 7 further comprising a yoke positioned between and connected to the biasing member and the lever arm.

10. The handle assembly of claim 9, wherein the lever arm comprises a first pivot pin extending from a first side; and a second pivot pin extending from a second side; and the yoke comprises a first pivot socket; and a second pivot socket; wherein the first pivot pin seats within the first pivot socket and the second pivot pin seats in the second pivot socket; and as the handle moves between the first position and the second position the first pivot pin rotates in the first pivot socket and the second pivot pin rotates in the second pivot socket.

11. The handle of claim 7, wherein the hub is rotatably connected to the back plate and pivotably to the lever arm.

12. The handle of claim 11, wherein the lever arm comprises an upper lever arm and a lower lever arm, and the upper lever arm is connected to the hub at a first location and the lower lever arm is connected to the hub at a second location vertically below the first location.

13. The handle of claim 12, wherein the hub further comprises a first flange; and a second flange; wherein the first flange is positioned on a first side of the back plate and the second flange is positioned on a second side of the back plate.

14. The handle of claim 5, wherein the actuating assembly comprises a button movably connected to the handle; and a latch configured to selectively engage the hub; wherein movement of the button relative to the handle in a first direction engages the latch to move the latch in the first direction disengaging the latch from the hub.

15. The handle of claim 14, wherein when the handle is in first position the latch prevents the biasing assembly from moving the handle to the second position; and movement of the button in the first direction disengages the latch from the support assembly.

16. A lever assembly for a lift and slide door system, the lever assembly comprising a support structure configured to connect to a door panel of the lift and slide door system;

a handle comprising a user selectable component;

a lever pivotably connected between and to both the handle and the support structure;

a biasing member connected to the lever; wherein selection by a user of the user selectable component releases the handle from a locked position, which allows the biasing member to move the handle and lever from a nested position within the support structure to an extended position relative to the support structure, and the biasing member extends and contracts along a direction parallel to a length of the handle regardless of position of the handle.

17. The lever assembly of claim 16, wherein the biasing member is substantially parallel to the lever when the handle is in the nested position and the biasing member is substantially perpendicular to the lever when the handle is in the extended position.

18. The lever assembly of claim 16, wherein the biasing member comprises a first spring and a second spring, wherein the first and second springs are connected to the lever and exert a biasing force on a first end of the lever.

19. The lever assembly of claim 16, wherein the user selectable component is a button.

20. The lever assembly of claim 16, wherein the handle defines a storage compartment and the biasing member is positioned in the storage compartment.

21. The lever assembly of claim 16, wherein the support structure further includes a rotatable hub configured to connect with a door lift mechanism for a lift and slide door;

the hub rotates with respect to the support structure; and the lever is pivotably attached to the hub.

22. The handle assembly of claim 1, wherein in a third position the handle is substantially flush with the surface of the door and is approximately 180 degrees offset relative to the first position and the handle selectively latches with the hub to prevent movement of the handle relative to the support frame.

* * * * *